US008257067B2

(12) United States Patent
Fukui et al.

(10) Patent No.: US 8,257,067 B2
(45) Date of Patent: Sep. 4, 2012

(54) HIGH PRESSURE PUMP

(75) Inventors: Masahiro Fukui, Kariya (JP); Yoshihito Suzuki, Toyokawa (JP); Katsunori Furuta, Obu (JP); Tatsumi Oguri, Okazaki (JP); Hiroshi Inoue, Anjo (JP)

(73) Assignee: Denso Corporation, Kariya (JP)

( * ) Notice: Subject to any disclaimer, the term of this patent is extended or adjusted under 35 U.S.C. 154(b) by 262 days.

(21) Appl. No.: 12/647,297

(22) Filed: Dec. 24, 2009

(65) Prior Publication Data

US 2010/0166584 A1 Jul. 1, 2010

(30) Foreign Application Priority Data

Dec. 26, 2008 (JP) ..... 2008-334842
Oct. 21, 2009 (JP) ..... 2009-242211

(51) Int. Cl.
*F04B 7/00* (2006.01)
*F04B 39/08* (2006.01)

(52) U.S. Cl. ..... 417/505

(58) Field of Classification Search ..... 417/505; 123/499

See application file for complete search history.

(56) References Cited

U.S. PATENT DOCUMENTS 5,899,194 A * 5/1999 Iwatsuki et al. ..... 123/527
6,253,734 B1 * 7/2001 Rembold et al. ..... 123/446
6,280,160 B1 * 8/2001 Nothdurft et al. ..... 417/462
6,345,608 B1 2/2002 Rembold et al.
6,631,706 B1 * 10/2003 Yamada et al. ..... 123/495
7,540,274 B2 * 6/2009 Yamada et al. ..... 123/506
2002/0033167 A1 * 3/2002 Hiraku et al. ..... 123/456
2003/0059322 A1 * 3/2003 Hiraku et al. ..... 417/505
2008/0245904 A1 * 10/2008 Harcombe et al. ..... 239/569

FOREIGN PATENT DOCUMENTS

JP 2001-173540 6/2001
JP 2001-295720 10/2001
JP 2002-521616 7/2002
JP 2004-218633 8/2004
JP 3598610 9/2004
JP 3833505 7/2006
JP 2008-248788 10/2008
JP 4285883 4/2009

* cited by examiner

*Primary Examiner* — Devon Kramer
*Assistant Examiner* — Amene Bayou
(74) *Attorney, Agent, or Firm* — Nixon & Vanderhye PC

(57) ABSTRACT

A volume chamber is formed by a valve member, an inner peripheral wall of a tubular portion and a bottom portion of a stopper when the valve member is engaged with tubular portion. A communication passage communicates between the volume chamber and one of an intermediate passage of a valve body and a tertiary passage of the stopper. The communication passage is formed at a location, which is spaced from a contact surface between the tubular portion and the valve member by a first predetermined distance and is also spaced from a contact surface between the bottom portion and the first urging member by a second predetermined distance.

18 Claims, 9 Drawing Sheets

HIGH PRESSURE PUMP

CROSS REFERENCE TO RELATED APPLICATION

This application is based on and incorporates herein by reference Japanese Patent Application No. 2008-334842 filed on Dec. 26, 2008 and Japanese Patent Application No. 2009-242211 filed on Oct. 21, 2009.

BACKGROUND OF THE INVENTION

1. Field of the Invention

The present invention relates to a high pressure pump, which pressurizes fuel drawn into a pressurizing chamber through reciprocal movement of a plunger.

2. Description of Related Art

A high pressure pump, which pressurizes fuel drawn into a pressurizing chamber through reciprocal movement of a plunger, is known. For example, Japanese Unexamined Patent Publication No. 2002-521616A (corresponding to U.S. Pat. No. 6,345,608B) discloses a high pressure pump that has a valve member provided in a fuel passage, which is communicated with a pressurizing chamber, to adjust a flow quantity of fuel supplied to the pressurizing chamber. The valve member is driven by an electromagnetic drive device. The electromagnetic drive device reciprocates the valve member toward and away from a valve seat formed in a valve body through a needle. A stopper is provided on one side of the valve member, at which the pressurizing chamber is located. The stopper limits the movement of the valve member toward the pressurizing chamber.

In the high pressure pump of Japanese Unexamined Patent Publication No. 2002-521616A, at the time of metering the fuel supplied to the fuel chamber, the fuel flows from the pressurizing chamber toward the valve member. In this stage, the flow of the fuel collides against an end surface of the valve member located on the side of the valve member, at which the pressurizing chamber is located. At this time, the collision force of the fuel, which collides against the end surface of the valve member, may serve as an assist force that assists the movement of the valve member toward the valve seat. In such a case, unintentionally, the valve member may possibly be seated against the valve seat, thereby resulting in the unstable metering of the fuel. Specifically, the valve member is seated against the valve seat at the time, during which the valve member is supposed to be lifted away from the valve seat. That is, the unintentional valve closing (hereinafter, also referred to as self-closing of the valve member) occurs. Therefore, the quantity of fuel, which is pressurized in the pressurizing chamber, becomes unstable, and thereby the quantity and the pressure of the fuel discharged from the high pressure pump may become unstable. Another high pressure pump recited in Japanese Patent No. 3598610B does not have a means for blocking a flow of fuel from a pressurizing chamber toward a valve member, so that at the time of metering the fuel, the flow of fuel collides against an end surface of the valve member, which is located on the pressurizing chamber side of the valve member. Therefore, when a cam, which drives a plunger, is rotated at a low rotational speed, the valve member may possibly be self-closed, like the high pressure pump of Japanese Unexamined Patent Publication No. 2002-521616A. In such a case, the quantity of fuel discharged from the high pressure pump cannot be controlled.

Furthermore, in another high pressure pump recited in Japanese Patent No. 3833505B, a cup shaped valve member, which is engageable with a stopper, is provided, and an urging member is provided radially inward of the valve member. A plurality of fuel flow passages extends through a bottom portion of the stopper. The stopper has a sliding surface, along which the valve member slides. With this construction, the urging force of the urging member always acts along the sliding surface of the valve member. Therefore, even when the urging member is slightly tilted, the slide movement of the valve member is not disadvantageously affected. Furthermore, in the engaged state, in which the stopper and the valve member are engaged with each other, the fuel can flow into the interior of the valve member. Therefore, the pressure of the fuel in the interior of the valve member and the pressure of the fuel outside of the valve member can be the same. Therefore, at the time of intentionally closing the valve member with the electromagnetic drive device, it is possible to avoid an occurrence of a state where the valve member cannot be lifted away from the stopper. However, in the high pressure pump of Japanese Patent No. 3833505B, the fuel flows into the interior of the valve member even in the state where the stopper and the valve member are engaged with each other. Therefore, the flow of the fuel collides against the bottom portion of the valve member. As a result, even when the cam is rotated at the low rotational speed, the valve member may possibly be self-closed, like the high pressure pumps of Japanese Unexamined Patent Publication No. 2002-521616A and of Japanese Patent No. 3598610B.

Another high pressure pump of Japanese Patent No. 4285883B includes a valve member, which has an umbrella-like valve head and is engageable with a stopper. When the stopper and the valve member are engaged with each other, a volume chamber is formed between the stopper and the valve member. A plurality of fuel flow passages (notches or recesses) is provided in an outer peripheral part of an engaging portion of the stopper, which is engageable with the valve member. Furthermore, an outer diameter of the engaging portion of the valve member is set to be smaller than a diameter (also referred to as a width) of the engaging portion of the stopper. Therefore, at the time of metering the fuel, the flow of the fuel is blocked by the stopper and thereby does not collide against an end surface of the valve member, which is located on a side of the valve member where the pressurizing chamber is located. In this way, the self-closing of the valve member is limited, and it is possible to limit lowering of the self-closing limit of the valve member (i.e., the lower limit of the cam rotational speed, at which the self-closing of the valve member does not occur). Furthermore, a slit-like flow passage is provided in the contact surface between the stopper and the valve member. Thereby, in the engaged state where the stopper and the valve member are engaged with each other, the fuel can flow into the volume chamber through the flow passage. Thus, similar to the high pressure pump of Japanese Patent No. 3833505B, at the time of intentionally closing the valve member, it is possible to avoid the occurrence of the state where the valve member cannot be removed from the stopper. However, in the high pressure pump of Japanese Patent No. 4285883B, when the flow of the fuel collides against an opposed portion of the valve member, which is opposed to the flow passage at the time of flowing of the fuel into the volume chamber through the flow passage, a lateral force is exerted in the valve member (a force that is applied to the valve member in a direction perpendicular to an axis of the valve member). A shaft of the valve member, which extends in a direction away from the stopper, is slidably guided. Therefore, when the lateral force is exerted to the valve member, the lateral force is applied to the sliding portion of the shaft of the valve member. Thus, the sliding malfunction or abnormal abrasion of the shaft of the valve member may possibly occur. Also, the attractive force of the electromagnetic drive device, which attracts the valve member, may possibly need to be increased.

SUMMARY OF THE INVENTION

The present invention addresses the above disadvantages. According to the present invention, there may be provided a high pressure pump, which includes a plunger, a valve body, a valve member, a stopper, a first urging member, a needle, a second urging member and an electromagnetic drive device. The plunger is reciprocally movable. The housing includes a pressurizing chamber, at which the plunger is placed to pressurize fuel in the pressurizing chamber, and a fuel passage, which guides the fuel to the pressurizing chamber. The valve body is placed in the fuel passage and includes a valve seat in a wall surface of the valve body on one side of the valve body, at which the pressurizing chamber is located. The valve member is placed in the valve body and is slidable along the valve body. The valve member includes a valve head, which is seatable against the valve seat to disable flow of the fuel through the fuel passage at a valve closing time of the valve member and is also liftable away from the valve seat to enable the flow of the fuel through the fuel passage at a valve opening time of the valve member. The stopper is placed on one side of the valve member, at which the pressurizing chamber is located. The stopper includes a tubular portion, a bottom portion and an annular expanded portion. The bottom portion closes one end part of the tubular portion, which is opposite from the valve member. The annular expanded portion extends radially outward from the bottom portion. When the valve member is engaged with the other end part of the tubular portion, which is opposite from the bottom portion, the stopper covers one end part of the valve member on the one side of the valve member, at which the pressurizing chamber is located, and limits movement of the valve member in a valve opening direction thereof, which is a direction away from the valve seat, so that a volume chamber is formed by the valve member, an inner peripheral wall of the tubular portion and the bottom portion. The first urging member is placed radially inward of the tubular portion and is engaged with the bottom portion at one end part of the first urging member and also with the valve member at the other end part of the first urging member to urge the valve member in a valve closing direction thereof, which is a direction toward the valve seat. The needle has one end part, which is engageable with the other end part of the valve member that is opposite from the stopper. The needle is movable together with the valve member in a common direction at the valve opening time or the valve closing time of the valve member. The second urging member urges the needle in the valve opening direction of the valve member. The electromagnetic drive device includes a coil arrangement, which attracts the needle in one of the valve closing direction and the valve opening direction of the valve member upon energization of the coil arrangement. The fuel passage includes a primary passage, a secondary passage, a tertiary passage and an intermediate passage. The primary passage is formed on one side of the valve seat of the valve body, which is opposite from the pressurizing chamber. The secondary passage is configured into an annular form, wherein the secondary passage is formed between the valve member and the valve seat when the valve member is lifted away from the valve seat. The tertiary passage is formed in the expanded portion of the stopper. The intermediate passage is formed between the secondary passage and the tertiary passage to communicate therebetween. The stopper includes a communication passage that communicates between the volume chamber and one of the intermediate passage and the tertiary passage. The communication passage is formed at a location, which is spaced from a contact surface between the tubular portion and the valve member by a first predetermined distance and is also spaced from a contact surface between the bottom portion and the first urging member by a second predetermined distance.

According to the present invention, there may be alternatively provided another high pressure pump, which includes a plunger, a valve body, a valve member, a stopper, a first urging member, a needle, a second urging member and an electromagnetic drive device. The plunger is reciprocally movable. The housing includes a pressurizing chamber, at which the plunger is placed to pressurize fuel in the pressurizing chamber, and a fuel passage, which guides the fuel to the pressurizing chamber. The valve body is placed in the fuel passage and includes a valve seat in a wall surface of the valve body on one side of the valve body, at which the pressurizing chamber is located. The valve member is placed in the valve body and is slidable along the valve body. The valve member includes a valve head, which is seatable against the valve seat to disable flow of the fuel through the fuel passage at a valve closing time of the valve member and is also liftable away from the valve seat to enable the flow of the fuel through the fuel passage at a valve opening time of the valve member. The stopper is placed on one side of the valve member, at which the pressurizing chamber is located. The stopper includes a tubular portion, a bottom portion and an expanded portion. The bottom portion closes one end part of the tubular portion, which is opposite from the valve member. The annular expanded portion extends radially outward from the bottom portion. When the valve member is engaged with the other end part of the tubular portion, which is opposite from the bottom portion, the stopper covers one end part of the valve member on the one side of the valve member, at which the pressurizing chamber is located, and limits movement of the valve member in a valve opening direction thereof, which is a direction away from the valve seat, so that a volume chamber is formed by the valve member, an inner peripheral wall of the tubular portion and the bottom portion. The first urging member is placed radially inward of the tubular portion and is engaged with the bottom portion at one end part of the first urging member and also with the valve member at the other end part of the first urging member to urge the valve member in a valve closing direction thereof, which is a direction toward the valve seat. The needle has one end part, which is engageable with the other end part of the valve member that is opposite from the stopper. The needle is movable together with the valve member in a common direction at the valve opening time or the valve closing time of the valve member. The second urging member urges the needle in the valve opening direction of the valve member. The electromagnetic drive device includes a coil arrangement, which attracts the needle in one of the valve closing direction and the valve opening direction of the valve member upon energization of the coil arrangement. The fuel passage includes a primary passage, a secondary passage, a tertiary passage and an intermediate passage. The primary passage is formed on one side of the valve seat of the valve body, which is opposite from the pressurizing chamber. The secondary passage is configured into an annular form. The secondary passage is formed between the valve member and the valve seat when the valve member is lifted away from the valve seat. The tertiary passage is formed in the expanded portion of the stopper. The intermediate passage is formed between the secondary passage and the tertiary passage to communicate therebetween. The valve head includes a recess that is formed in a surface of the valve head on one side of the valve head, at which the stopper is located, and is recessed in a direction that is opposite from the stopper. The other end part of the first urging member, which is opposite from the bottom portion, is engaged with the recess. The valve member includes a communication passage, which communicates between the intermediate passage and the volume chamber. The communication passage is formed at a location, which is spaced from a contact surface between the recess and the first urging member by a first predetermined distance and is also spaced from a contact surface between the valve member and the tubular portion by a second predetermined distance.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

Figure 1:
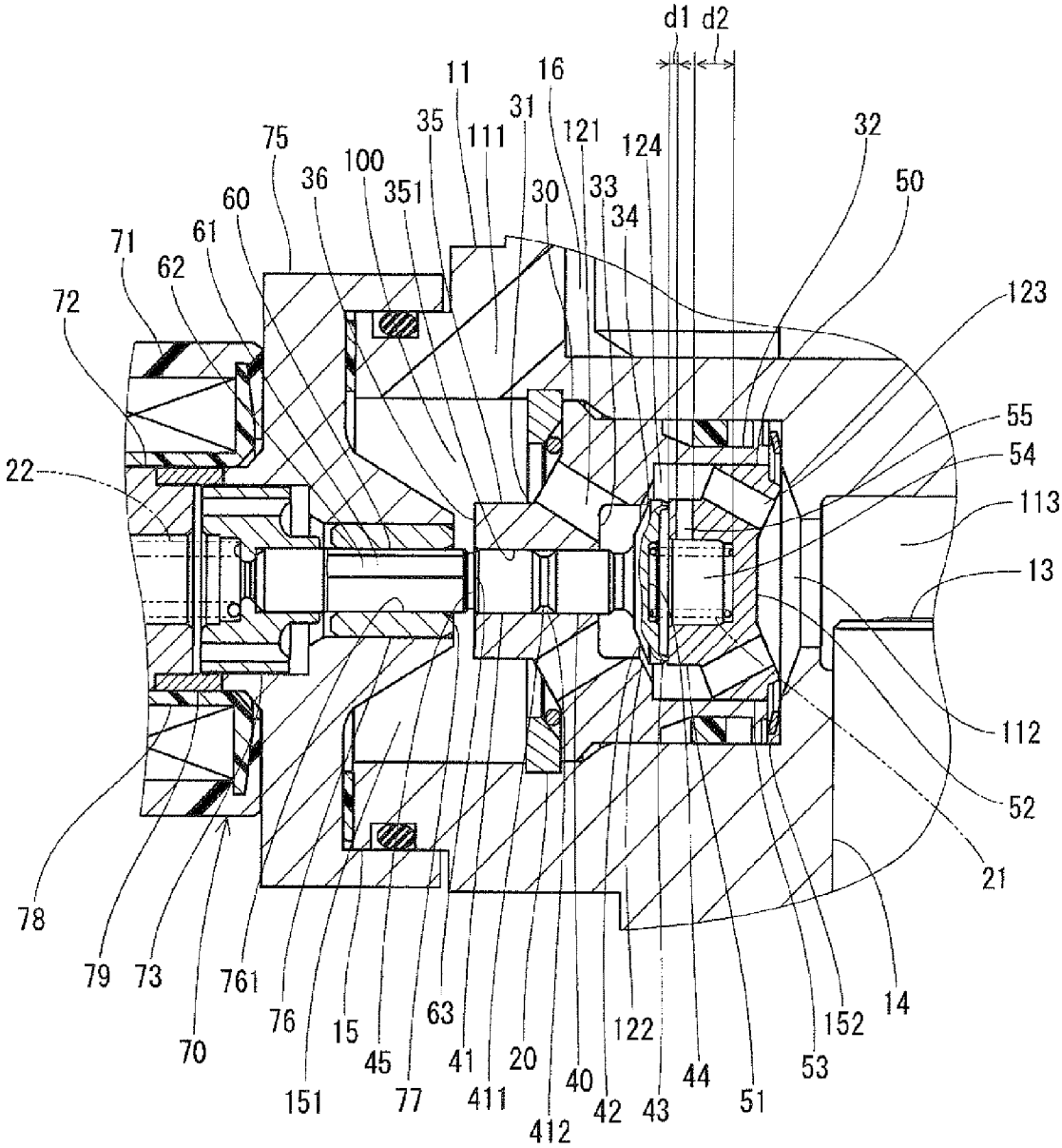
FIG. 1 is a partial enlarged cross-sectional view of a high pressure pump according to a first embodiment of the present invention.

Various embodiments of the present invention will be described with reference to the accompanying drawings. In the following embodiments, similar components will be indicated by the same reference numerals throughout the following description and will not be described redundantly for the sake of simplicity.

First Embodiment

FIGS. 1 to 4 show a high pressure pump according to a first embodiment of the present invention. The high pressure pump 10 is a fuel pump that supplies fuel to an injector of an internal combustion engine (e.g., a diesel engine, a gasoline engine).

Figure 2:
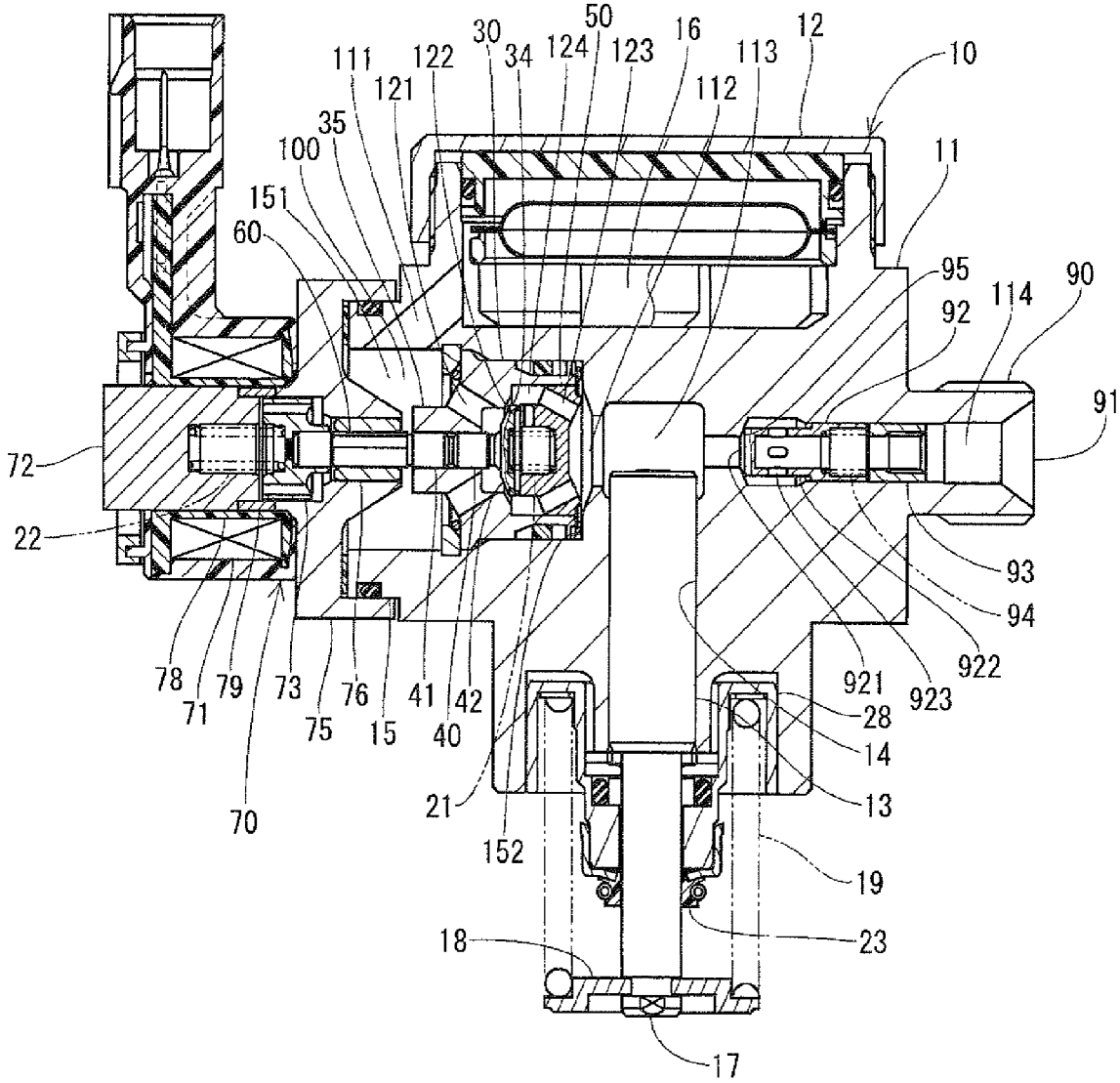
FIG. 2 is a cross sectional view of the high pressure pump of the first embodiment.

As shown in FIG. 2, the high pressure pump 10 includes a housing main body 11, a cover 12, a valve body 30, a valve member 40, a stopper 50, a spring 21, a needle 60, a spring 22 and an electromagnetic drive device 70.

The housing main body 11 and the cover 12 serves as a housing of the present invention. The housing main body 11 is made of, for example, martensitic stainless steel. The housing main body 11 forms a cylinder 14. A plunger 13 is axially reciprocally supported in the cylinder 14 of the housing main body 11.

The housing main body 11 forms a guide passage 111, an intake passage 112, a pressurizing chamber 113 and a delivery passage 114. The housing main body 11 has a tubular portion 15. The tubular portion 15 forms a passage 151, which communicates between the guide passage 111 and the intake passage 112. The tubular portion 15 extends in a direction generally perpendicular to a central axis of the cylinder 14. An inner diameter of the tubular portion 15 changes along a length of the tubular portion 15. The tubular portion 15 of the housing main body 11 has a stepped surface 152, at which the inner diameter of the tubular portion 15 changes. A valve body 30 is provided in the passage 151, which is formed in the tubular portion 15.

A fuel chamber 16 is formed between the housing main body 11 and the cover 12. A fuel inlet (not shown), which is communicated with the fuel chamber 16, is formed in the housing main body 11. A low pressure fuel pump (not shown) pumps fuel out of a fuel tank and supplies the fuel to the fuel chamber 16 through the fuel inlet of the of housing main body 11. The guide passage 111 communicates between the fuel chamber 16 and the passage 151 of the tubular portion 15. One end part of the intake passage 112 is communicated with the pressurizing chamber 113. The other end part of the intake passage 112 is opened on an inner peripheral side of the stepped surface 152. As shown in FIG. 1, the guide passage 111 and the intake passage 112 are communicated with each other through the inner peripheral part of the valve body 30. As shown in FIG. 2, the pressurizing chamber 113 is communicated with the delivery passage 114 on the side opposite from the intake passage 112. The guide passage 111, the passage 151 and the intake passage 112 collectively serve as a fuel passage of the present invention. In the present embodiment, the fuel passage is indicated by numeral 100.

The plunger 13 is supported in the cylinder 14 of the housing main body 11 in such a manner that the plunger 13 is axially reciprocable in the cylinder 14. The pressurizing chamber 113 is formed at one end of the plunger 13 such that the pressurizing chamber 113 is located on one axial side of the plunger 13 in a reciprocating direction of the plunger 13. A head 17, which is provided at the other end of the plunger 13, is connected to a spring seat 18. A spring 19 is placed between the spring seat 18 and an oil seal holder 28, which is fixed to the housing main body 11. The spring seat 18 is urged by an urging force of the spring 19 toward a cam (not shown). The plunger 13 is engaged with the cam through a tappet (not shown) and is thereby reciprocated.

One end part of the spring 19 is engaged with the oil seal holder 28, and the other end part of the spring 19 is engaged with the spring seat 18. The spring 19 exerts an axial resilient force. In this way, the spring 19 urges the tappet (not shown) through the spring seat 18 toward the cam. An oil seal 23 fluid-tightly seals between an outer peripheral surface of a head 17 side portion of the plunger 13 and an inner peripheral surface of the housing main body 11, which forms the cylinder 14 that receives the plunger 13. The oil seal 23 limits intrusion of the oil from the interior of the engine to the pressurizing chamber 113 and also limits the outflow of fuel from the pressurizing chamber 113 to the engine.

A delivery valve arrangement 90, which forms a fuel outlet 91, is provided on a delivery passage 114 side of the housing main body 11. The delivery valve arrangement 90 enables and disables discharging of fuel, which is pressurized in the pressurizing chamber 113. The delivery valve arrangement 90 includes a check valve 92, a limiting member 93 and a spring 94. The check valve 92 includes a bottom portion 921 and a tubular portion 922. The tubular portion 922 extends from the bottom portion 921 on a side opposite from the pressurizing chamber 113. Thereby, the check valve 92 is configured into a cup shape. The check valve 92 is reciprocally placed in the delivery passage 114. The limiting member 93 is configured into a tubular form and is fixed to the housing main body 11, which forms the delivery passage 114. One end part of the spring 94 is engaged with the limiting member 93, and the other end part of the spring 94 is engaged with the tubular portion 922 of the check valve 92. The check valve 92 is urged toward a valve seat 95, which is formed in the housing main body 11, by the urging force of the spring 94. When the bottom portion 921 side end part of the check valve 92 is seated against the valve seat 95, the check valve 92 closes the delivery passage 114 to disable the fuel flow through the delivery passage 114. In contrast, when the bottom portion 921 side end part of the check valve 92 is lifted away from the valve seat 95, the delivery passage 114 is opened to enable the fuel flow through the delivery passage 114. When the check valve 92 is moved in the direction opposite from the valve seat 95, the end part of the tubular portion 922, which is opposite from the bottom portion 921, is engaged with the limiting member 93 to limit the further movement of the check valve 92.

When the pressure of the fuel in the pressurizing chamber 113 is increased, the force, which is applied to the check valve 92 from the fuel at the pressurizing chamber 113 side, is increased. When the force, which is applied to the check valve 92 from the fuel at the pressurizing chamber 113 side, becomes larger than a sum of the urging force of the spring 94 and the force, which is applied to the check valve 92 from the fuel on the downstream side of the valve seat 95, i.e., the fuel in a delivery pipe (not shown), the check valve 92 is lifted away from the valve seat 95. In this way, the fuel in the pressurizing chamber 113 is discharged out of the high pressure pump 10 from the fuel outlet 91 through the delivery passage 114, more specifically, through the through holes 923 formed through the peripheral wall of the tubular portion 922, and the interior of the tubular portion 922.

When the pressure of the fuel in the pressurizing chamber 113 is reduced, the force, which is applied to the check valve 92 from the fuel at the pressurizing chamber 113 side, is reduced. When the force, which is applied to the check valve 92 from the fuel in the pressurizing chamber 113, becomes smaller than the sum of the urging force of the spring 94 and the force, which is applied to the check valve 92 from the fuel on the downstream side of the valve seat 95, the check valve 92 is seated against the valve seat 95. In this way, it is possible to limit the flow of the fuel from the interior of the delivery pipe (not shown) into the pressurizing chamber 113 through the delivery passage 114.

As shown in FIG. 1, the valve body 30 is fixed to the housing main body 11. The valve body 30 is fixed to the interior of the passage 151 by, for example, the press-fit engagement of the valve body 30 into the passage 151 and engagement of an engaging member 20. Specifically, the valve body 30 is provided in the passage 151, which forms the fuel passage 100. The valve body 30 includes a bottom portion 31 and a tubular portion 32. The tubular portion 32 extends from the bottom portion 31 toward the pressurizing chamber 113 side. Thereby, the valve body 30 is configured into a cup shape.

The valve body 30 has a recess 33, which is provided in the bottom portion 31 on a pressurizing chamber 113 side thereof and is recessed in a direction opposite from the pressurizing chamber 113. A valve seat 34 is formed at a wall surface of the bottom portion 31 on the pressurizing chamber 113 side of the bottom portion 31 along an outer peripheral edge of the recess 33. Specifically, the valve body 30 has the valve seat 34 in the pressurizing chamber 113 side wall surface of the valve body 30. The valve seat 34 is tapered such that the surface of the valve seat 34 defines a predetermined angle relative to the axis of the valve body 30.

The valve body 30 has a first guide portion 35 at a center part of the bottom portion 31. The first guide portion 35 is formed to project from the center part of the bottom portion 31 in a direction opposite from the recess 33. The valve body 30 has a first receiving through hole 351. The first receiving through hole 351 communicates between a wall surface of the valve body 30, which forms the recess 33 of the first guide portion 35, and a wall surface 36 of the first guide portion 35, which is opposite from the recess 33. Primary passages 121 are formed in the bottom portion 31 at a location radially outward of the first receiving through hole 351 to communicate between the wall surface of the valve body 30, which forms the recess 33, and the wall surface of the bottom portion 31, which is opposite from the recess 33. The primary passages 121 are placed one after another in a circumferential direction about the axis of the valve body 30.

The valve member 40 has a shaft 41 and a valve head 42. The shaft 41 is configured into a generally cylindrical form. The valve head 42 is joined to a pressurizing chamber 113 side end part of the shaft 41 and is configured into a generally circular disk form (an umbrella-like form). The valve member 40 has a projection 43, which is configured into a tubular form and radially outwardly projects from an outer peripheral edge of the valve head 42 in a direction that is opposite from the shaft 41. Furthermore, in the valve member 40, a recess 44 is formed in a surface of the valve head 42 on one side of the valve head 42, at which the pressurizing chamber 113 and the stopper 50 are located, and is recessed in a direction that is opposite from the pressurizing chamber 113. The shaft 41 is received through the first receiving through hole 351 of the first guide portion 35 and is axially reciprocable in the axial direction of the shaft 41 in the interior of the valve body 30. The wall surface of the valve head 42 on the valve seat 34 side thereof is tapered to correspond with the shape of the valve seat 34 and is angled at a predetermined angle relative to the axis of the shaft 41. The valve member 40 disables and enables the flow of fuel through the fuel passage 100 when the valve head 42 is seated against and is lifted away from the valve seat 34 upon reciprocation of the valve member 40. Furthermore, in the valve member 40, a secondary passage 122, which is configured into an annular form, is formed between the valve head 42 and the valve seat 34 when the valve head 42 is lifted away from the valve seat 34.

An inner diameter of the first receiving through hole 351 of the first guide portion 35 is generally the same as or slightly larger than an outer diameter of the shaft 41 of the valve member 40. In this way, the valve member 40 reciprocates in the interior of the valve body 30 such that the outer peripheral wall surface of the shaft 41 slides along the wall surface of the first guide portion 35, which forms the first receiving through hole 351. Therefore, when the valve member 40 reciprocates, the valve member 40 is guided by the first guide portion 35.

In the middle of the axial length of the shaft 41, the shaft 41 has a small diameter portion 411, which is radially inwardly recessed from the outer peripheral wall surface of the shaft 41. With this construction, a contact surface area between the shaft 41 and the first guide portion 35 becomes smaller in comparison to a case where the shaft 41 does not have the small diameter portion 411. Thereby, when the valve member 40 is reciprocated, the slide resistance between the shaft 41 and the first guide portion 35 is advantageously reduced. Furthermore, the small diameter portion 411 has a function of lubricating the sliding portion of the shaft 41.

A fuel well 412, which is configured into an annular form, is formed between the small diameter portion 411 and the inner peripheral wall surface of the first guide portion 35, which forms the first receiving through hole 351. The fuel, which is received in the recess 33 of the first guide portion 35, is supplied to and is held in the fuel well 412 after passing through the gap between the outer peripheral wall surface of the shaft 41 and the inner peripheral wall surface of the first guide portion 35 that forms the first receiving through hole 351. Also, the fuel, which is located on the side of the first guide portion 35 that is opposite from the recess 33, is supplied to and is held in the fuel well 412 after passing through the gap between the outer peripheral wall surface of the shaft 41 and the inner peripheral wall surface of the first guide portion 35 that forms the first receiving through hole 351. Therefore, when the valve member 40 is reciprocated, the fuel, which is received in the fuel well 412, adheres to the inner peripheral wall surface of the first guide portion 35. In this way, it is possible to reduce the slide resistance between the shaft 41 and the first guide portion 35.

The stopper 50 is provided on a pressurizing chamber 113 side of the valve member 40. The stopper 50 includes a tubular portion 51, a bottom portion 52 and an en enlarged portion 53. The bottom portion 52 closes an end of the tubular portion 51 on the side opposite from the valve member 40. The enlarged portion 53 is configured into an annular form and extends radially outward from the bottom portion 52. An outer peripheral wall surface of the enlarged portion 53 of the stopper 50 is welded to the inner peripheral wall surface of the tubular portion 32 of the valve body 30, so that the stopper 50 is fixed to the valve body 30.

The spring 21, which serves as a first urging member, is provided between the stopper 50 and the valve member 40. One end part of the spring 21 is engaged with the bottom portion 52 at radially inward of the tubular portion 51 of the stopper 50, and the other end part of the spring 21 is engaged with the recess 44 of the valve member 40. The spring 21 exerts an axial expansion force (resilient force) to urge the valve member 40 in a direction opposite from the stopper 50, i.e., in a valve closing direction. In the present embodiment, the spring 21 is formed into a coil form, and opposed end parts of the spring 21 are wound once or multiple times to form end turn portions. At each of the opposed end parts (the end turn portions) of the coil spring 21, a gap between adjacent coils of the spring 21 is set to be generally zero. Furthermore, at the remaining portion of the spring 21, which is other than the end parts (the end turn portions) of the coil spring 21, the gap between the adjacent coils of the spring 21 is set to be a predetermined value. In the present embodiment, one or both of the end parts of the spring 21 may be ground or polished to adjust a set load of the spring having a set length. Therefore, it is possible to accurately set the set load of the spring 21.

An end part of the tubular portion 51 of the stopper 50, which is located on the valve member 40 side thereof, is engageable with an end part of the projection 43 of the valve member 40, which is located on the stopper 50 side thereof. A radial width of the wall surface (the end wall surface in this instance) of the projection 43, which is engageable with the tubular portion 51, is made smaller than a radial width of the wall surface (the end wall surface in this instance) of the tubular portion 51, which is engageable with the projection 43. In other words, the outer diameter of the wall surface of the projection 43, which is engageable with the tubular portion 51, is made smaller than the outer diameter of the wall surface of the tubular portion 51, which is engageable with the projection 43. In this particular instance, the above relationship is made possible by making the outer diameter of the projection 43 smaller than the outer diameter of the tubular portion 51. A contact surface area (an engaging surface area) between the projection 43 and the tubular portion 51 is a surface area of the wall surface of the projection 43, which is located on the tubular portion 51 side thereof.

When the valve member 40 is engaged with the stopper 50, the stopper 50 forms a volume chamber 54, which is defined, i.e., formed by the valve member 40, the inner peripheral wall surface of the tubular portion 51 and the bottom portion 52. Furthermore, at this time, the stopper 50 limits the movement of the valve member 40 toward the pressurizing chamber 113 side, i.e., in the valve opening direction.

When the projection 43 of the valve member 40 is engaged with the tubular portion 51 of the stopper 50, the stopper 50 closes an opening of the projection 43, which is located on the pressurizing chamber 113 side thereof. Thereby, at this time, the fuel, which is directed from the pressurizing chamber 113 side toward the valve member 40 side, the collision of the fuel against the valve member 40 is alleviated or limited.

Tertiary passages 123 are formed in the enlarged portion 53 of the stopper 50 to communicate between the wall surface of the enlarged portion 53, which is located on the pressurizing chamber 113 side of the enlarged portion 53, and the other wall surface of the enlarged portion 53, which is located on the side opposite from the pressurizing chamber 113. The tertiary passages 123 are placed one after another in a circumferential direction about the axis of the stopper 50.

An intermediate passage 124 is formed between the secondary passage 122 and the tertiary passages 123 to communicate between them. The intermediate passage 124 is configured into an annular form and is defined by the inner peripheral wall surface of the tubular portion 32 of the valve body 30 and the outer peripheral wall surface of the tubular portion 51 of the stopper 50.

Figure 3:
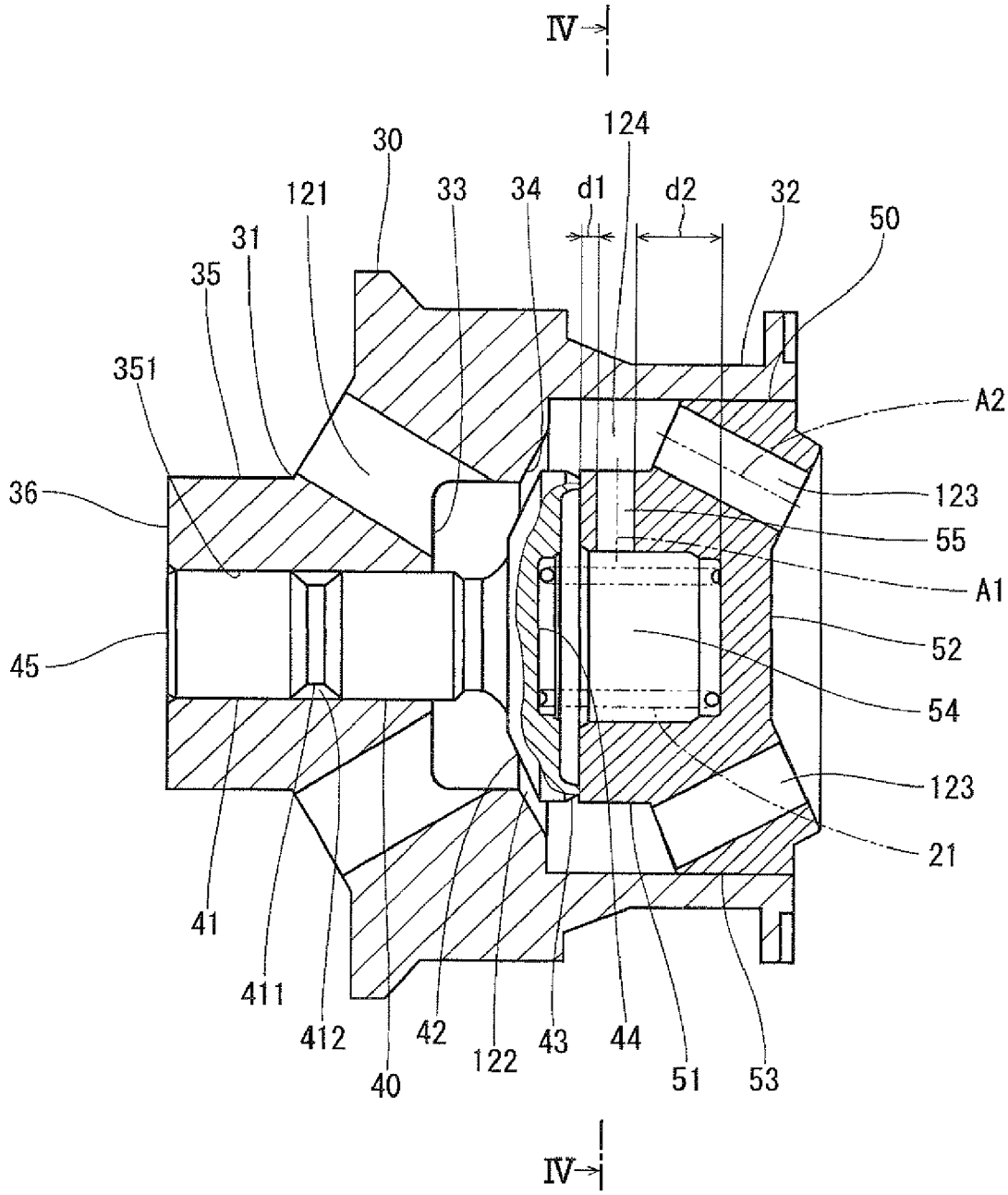
FIG. 3 is an enlarged partial cross-sectional view showing a valve body, a valve member and a stopper of the high pressure pump of the first embodiment.

A communication passage 55, which communicates between the volume chamber 54 and the intermediate passage 124, is formed through the tubular portion 51 of the stopper 50 in the radial direction. As shown in FIG. 3, the communication passage 55 is formed at a location, which is spaced from the contact surface between the tubular portion 51 of the stopper 50 and the valve member 40 by a first predetermined distance (first side distance) d1 and is also spaced from the contact surface between the bottom portion 52 of the stopper 50 and the spring 21 by a second predetermined distance (second side distance) d2. Here, desirably, among the first predetermined distance d1 and the second predetermined distance d2, at least the second predetermined distance d2 is set to be larger than the axial length of the end turn portion of the spring 21.

In the engaged state where the stopper 50 and the valve member 40 are engaged with each other (the state where the volume chamber 54 is formed), the communication passage 55 is spaced from the valve member 40 by the first predetermined distance d1. Therefore, it is possible to limit the collision of the fuel against the valve member 40 upon intrusion of the fuel into the volume chamber 54 through the communication passage 55.

In the engaged state where the stopper 50 and the valve member 40 are engaged with each other, the communication passage 55 is spaced from the contact surface between the recess 44 of the valve member 40 and the spring 21 by the first predetermined distance d1 or more. Furthermore, the communication passage 55 is spaced from the contact surface between the bottom portion 52 and the spring 21 by the second predetermined distance d2. Specifically, the communication passage 55 is spaced from each of the opposed end parts (the end turn portions) of the spring 21 by the corresponding predetermined distance. Therefore, the fuel, which is introduced into the volume chamber 54 through the communication passage 55, can easily pass through each gap between the corresponding adjacent coils of the spring 21 (other than the end turn portions).

Furthermore, the communication passage 55 and the tertiary passages 123 are formed such that a central axis A1 of the communication passage 55 extends in a direction that is different from that of a central axis AZ of each of the tertiary passages 123. Specifically, the flow direction of the fuel, which flows through the communication passage 55, differs from the flow direction of the fuel, which flows through any one of the tertiary passages 123.

Figure 4:
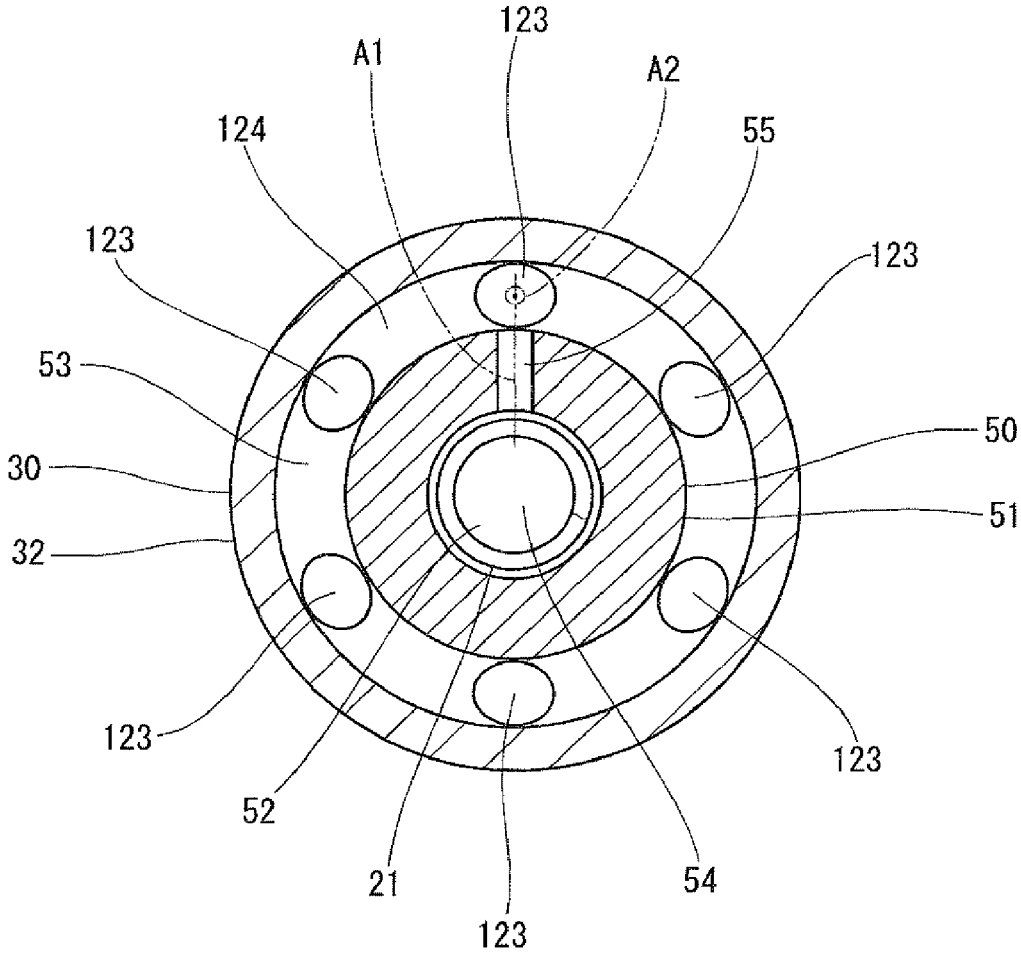
FIG. 4 is a cross sectional view taken along line IV-IV in FIG. 3.

As shown in FIG. 4, the communication passage 55 is placed such that the central axis A1 of the communication passage 55 intersects with the central axis A2 of one of the tertiary passages 123. Specifically, when the fuel flows from the pressurizing chamber 113 through the tertiary passages 123, the secondary passage 122 and the primary passages 121, the communication passage 55 is communicated with the intermediate passage 124 at a location, which is adjacent to the one of the tertiary passages 123 on the downstream side of the tertiary passage 123.

The primary passages 121, the secondary passage 122, the tertiary passages 123 and the intermediate passage 124 are included in the passage 151, which is formed in the housing main body 11. That is, the fuel passage 100 includes the primary passages 121, the secondary passage 122, the tertiary passages 123 and the intermediate passage 124. Thereby, when the fuel flows from the fuel chamber 16 toward the pressurizing chamber 113, the fuel flows through the primary passages 121, the secondary passage 122, the intermediate passage 124 and the tertiary passages 123 in this order. Contrary to this, when the fuel flows from the pressurizing chamber 113 toward the fuel chamber 16, the fuel flows through the tertiary passages 123, the intermediate passage 124, the secondary passage 122 and the primary passages 121 in this order.

As shown in FIG. 2, the electromagnetic drive device 70 includes a coil 71, a stator core 72, a movable core 73 and a flange 75. The coil 71 is wound around a spool 78, which is made of resin. When the coil 71 is energized, the coil 71 generates a magnetic field. The stator core 72 is made of a magnetic material. The stator core 72 is received radially inward of the coil 71. The movable core 73 is made of a magnetic material. The movable core 73 is opposed to the stator core 72. The movable core 73 is received radially inward of a tubular member 79 made of a non-magnetic material and a flange 75 in such a manner that the movable core 73 is axially reciprocable. The tubular member 79 limits the magnetic short-circuiting between the stator core 72 and the flange 75.

The flange 75 is made of a magnetic material. As shown in FIG. 1, the flange 75 is installed to the tubular portion 15 of the housing main body 11. Thereby, the flange 75 holds the electromagnetic drive device 70 relative to the housing main body 11 and closes the end of the tubular portion 15. The flange 75 has a second guide portion 76 that is configured into a tubular form and is placed at the center of the flange 75. The second guide portion 76 has a second receiving through hole 761, which communicates between one side of the flange 75, at which the valve body 30 is located, and the other side of the flange 75, which is opposite from the valve body 30.

The needle 60 is configured into a generally cylindrical form and is received through the second receiving through hole 761, which is formed in the second guide portion 76 of the flange 75. The needle 60 is received in the second receiving through hole 761 in such a manner that the needle 60 is axially reciprocable in the second receiving through hole 761. An inner diameter of the second receiving through hole 761 is generally the same as or slightly larger than the outer diameter of the needle 60. With this construction, the needle 60 is reciprocated in the second receiving through hole 761 in such a manner that the outer peripheral wall surface of the needle 60 slides along the inner peripheral wall surface of the second guide portion 76, which forms the second receiving through hole 761. Therefore, when the needle 60 reciprocates, the needle 60 is guided by the second guide portion 76.

The needle 60 has a generally planar wall surface 61, which is formed by chamfering a portion of the outer peripheral wall of the needle 60. When the portion of the outer peripheral wall of the needle 60 is chamfered in this manner, a contact surface area between the needle 60 and the second guide portion 76 is reduced. In this way, it is possible to reduce the slide resistance between the needle 60 and the second guide portion 76.

A gap 62 is formed between the wall surface 61 of the needle 60 and the inner peripheral wall surface of the second guide portion 76, which forms the second receiving through hole 761. Therefore, the fuel, which is located on the one side of the flange 75 where the valve body 30 is located, can flow toward the other side of the flange 75 that is opposite from the valve body 30 through the gap 62. In this way, the pressure on the one side of the flange 75 where the valve body 30 is located becomes generally the same as the pressure on the other side of the flange 75 that is opposite from the valve body 30. Furthermore, the gap 62 also serves as an air bleeding passage for bleeding the air accumulated around the movable core 73.

One end part of the needle 60 is press fitted to or welded to the movable core 73, so that the needle 60 is installed integrally with the movable core 73. Furthermore, an end surface 63, which is formed in the other end part of the needle 60, is engageable with an end surface 45, which is formed in the end part of the shaft 41 of the valve member 40 on the side opposite from the valve head 42. The needle 60 is movable in the same direction as the moving direction of the valve member 40 at the valve opening time or valve closing time of the valve member 40.

The spring 22, which serves as a second urging member, is placed between the stator core 72 and the movable core 73. The spring 22 urges the movable core 73 toward the valve member 40. The urging force of the spring 22, which urges the movable core 73, is larger than the urging force of the spring 21, which urges the valve member 40. Specifically, the spring 22 urges the movable core 73 and the needle 60 toward the valve member 40, i.e., in the valve opening direction of the valve member 40 against the urging force of the spring 21. In this way, when the coil 71 is not energized, the stator core 72 and the movable core 73 are spaced from each other. Therefore, when the coil 71 is not energized, the needle 60, which is integrated with the movable core 73, is moved toward the valve member 40 by the urging force of the spring 22, and thereby the valve member 40 is lifted away from the valve seat 34 of the valve body 30. The coil 71, the stator core 72, the movable core 73, the flange 75, the spool 78 and the tubular member 79 of the electromagnetic drive device 70 collectively serve as a coil arrangement of the present invention.

Next, the operation of the high pressure pump 10 will be described.

First of all, a suction stroke of the plunger 13 will be discussed.

At the time of moving the plunger 13 downward in FIG. 2, the energization of the coil 71 is stopped. Therefore, the valve member 40 is urged by the needle 60, which is integrated with the movable core 73 that receives the force from the spring 22 of the electromagnetic drive device 70, toward the pressurizing chamber 113. Thereby, the valve member 40 is lifted away from the valve seat 34 of the valve body 30. Also, when the plunger 13 is moved downward in FIG. 2, the pressure of the pressurizing chamber 113 is reduced. As a result, the force, which is applied to the valve member 40 from the fuel on one side of the valve member 40 where the recess 33 is located, becomes larger than the force, which is applied to the valve member 40 from the fuel on the other side of the valve member 40 where the pressurizing chamber 113 is located. Thereby, the force is applied to the valve member 40 in the direction away from the valve seat 34, i.e., in the valve opening direction, so that the valve member 40 is lifted away from the valve seat 34. The valve member 40 is moved until the projection 43 is engaged with the tubular portion 51 of the stopper 50. When the valve member 40 is lifted away from the valve seat 34, i.e., when the valve opening of the valve member 40 is executed, the fuel chamber 16 is communicated with the pressurizing chamber 113 through the guide passage 111, the passage 151 and the intake passage 112. Therefore, the fuel in the fuel chamber 16 is drawn into the pressurizing chamber 113 through the primary passages 121, the secondary passage 122, the intermediate passage 124 and the tertiary passages 123 in this order. Furthermore, at this time, the valve member 40 is engaged with the stopper 50, so that the opening of the projection 43, which is located on the pressurizing chamber 113 side of the projection 43, is closed with the stopper 50. Furthermore, at this time, the fuel in the intermediate passage 124 can flow into the volume chamber 54 through the communication passage 55. Therefore, the pressure of the volume chamber 54 becomes equal to the pressure of the intermediate passage 124.

At this time, the communication passage 55 is spaced from the valve member 40 by the first predetermined distance d1, so that it is possible to limit the collision of the fuel, which flows into the volume chamber 54 through the communication passage 55, against the valve member 40. Also, the communication passage 55 is spaced from the opposed end parts (the end turn portions) of the spring 21 by the corresponding predetermined distances, respectively, so that the it is possible to limit the collision of the fuel, which flows into the volume chamber 54 through the communication passage 55, against the end turn portions of the spring 21. Therefore, it is possible to limit the exertion of the lateral force against the valve member. Furthermore, the fuel, which flows into the volume chamber 54 though the communication passage 55, can pass through each gap between the corresponding adjacent coils of the spring 21, i.e., can pass through the portion of the spring 21, which is other than the end turn portions. As a result, the fuel can smoothly flow into the volume chamber 54.

Now, a metering stroke of the plunger 13 will be described.

When the plunger 13 is driven from the bottom dead center toward the top dead center, the flow of the fuel, which flows from the pressurizing chamber 113 toward the valve member 40, i.e., toward the fuel chamber 16, may possibly result in the application of the force against the valve member 40 toward the valve seat 34. However, when the coil 71 is not energized, the needle 60 is urged toward the valve member 40 by the urging force of the spring 22. Therefore, the movement of the valve member 40 toward the valve seat 34 is limited by the needle 60. Furthermore, in the valve member 40, the opening of the projection 43, which is located on the pressurizing chamber 113 side thereof, is closed by the stopper 50. In this way, the flow of the fuel, which outflows from the pressurizing chamber 113 toward the fuel chamber 16, does not directly collide against the valve member 40. Therefore, the force, which is applied from the flow of the fuel against the valve member 40, is alleviated.

At this time, the pressure of the volume chamber 54 becomes equal to the pressure of the intermediate passage 124. In the present embodiment, the flow direction of the fuel, which flows through the communication passage 55, differs from the flow direction of the fuel, which flows through any one of the tertiary passages 123. Thereby, in the metering stroke, it is possible to reduce the direct flow of the fuel, which is supplied from the tertiary passages 123 into the intermediate passage 124, into the communication passage 55. Therefore, it is possible to alleviate the strong collision of the fuel, which is supplied from the intermediate passage 124 into the volume chamber 54 through the communication passage 55, against the valve member 40.

In the metering stroke, the fuel, which flows in each tertiary passage 123, has an increased flow velocity due to a choking effect at the time of flowing from the pressurizing chamber 113 toward the tertiary passage 123. Therefore, the flow velocity of the fuel in the intermediate passage 124 at the location adjacent to the tertiary passage 123 on the downstream side of the tertiary passage 123 is increased, and the corresponding pressure at this location is reduced. In the present embodiment, the communication passage 55 is communicated with the intermediate passage 124 at the location adjacent to the corresponding tertiary passage 123 on the downstream side of the tertiary passage 123. Therefore, the pressure of the volume chamber 54 becomes the low pressure, which is equal to the pressure of the intermediate passage 124 on the downstream side of the corresponding tertiary passage 123. Also, the spring 21 is provided in the interior of the tubular portion 51 of the stopper 50, so that the volume chamber 54 has the predetermined volume. Thereby, it is possible to reduce the degree of the pressure change in the volume chamber 54.

As discussed above, according to the present embodiment, in the metering stroke, the fuel, which flows into the volume chamber 54 through the communication passage 55, will not strongly collide against the valve member 40, and the pressure of the volume chamber 54 will become the low pressure. Therefore, in the metering stroke, it is possible to reduce the possibility of the removing of the valve member 40 away from the stopper 50 caused by the flow or the pressure of the fuel in the volume chamber 54. Thus, it is possible to limit the self-closing of the valve member 40.

Because of the above discussed reason, in the metering stroke, the valve member 40 is kept lifted away from the valve seat 34 in the state where the coil 71 is not energized. In this way, the fuel, which is discharged from the pressurizing chamber 113 upon the upward movement of the plunger 13, will be returned to the fuel chamber 16 through the tertiary passages 123, the intermediate passage 124, the secondary passage 122 and the primary passages 121 in this order, which is opposite from the flow direction of the fuel at the time of drawing the fuel from the fuel chamber 16 into the pressurizing chamber 113.

When the coil 71 is energized in the middle of the metering stroke, a magnetic field is generated by the coil 71 to form a magnetic circuit in the stator core 72, the flange 75 and the movable core 73. In this way, the magnetic attractive force is generated between the stator core 72 and the movable core 73, which have been spaced from each other before the energization of the coil 71. When the magnetic attractive force, which is generated between the stator core 72 and the movable core 73, is increased beyond the urging force of the spring 22, the movable core 73 is moved toward the stator core 72. Thereby, the needle 60, which is integrated with the movable core 73, is also moved toward the stator core 72. When the needle 60 is moved toward the stator core 72, the valve member 40 and the needle 60 are spaced from each other. Therefore, the valve member 40 does not receive the force from the needle 60. Therefore, the valve member 40 is moved away from the stopper 50 toward the valve seat 34 by the force applied to the valve member 40 in the valve closing direction from the flow of the fuel discharged from the pressurizing chamber 113 toward the fuel chamber 16. In this way, the valve member 40 is closed.

In the present embodiment, the communication passage 55 is formed through the tubular portion 51 of the stopper 50 to communicate between the intermediate passage 124 and the volume chamber 54, Therefore, the pressure of the volume chamber 54, which is formed by the inner peripheral wall of the tubular portion 51, becomes equal to the pressure of the intermediate passage 124, which is located radially outward of the tubular portion 51. That is, even when the pressure of the intermediate passage 124 becomes the high pressure, the pressure of the intermediate passage 124 does not become larger than the pressure of the volume chamber 54. Furthermore, in the present embodiment, the contact surface area between the projection 43 of the valve member 40 and the tubular portion 51 of the stopper 50 is small, so that the ringing force, which acts on the contact surface between the projection 43 and the tubular portion 51, is small.

As discussed above, regardless of the pressure of the intermediate passage 124, the pressure of the intermediate passage 124 does not become larger than the pressure of the volume chamber 54, and the ringing force, which is applied on the contact surface between the projection 43 and the tubular portion 51, is small. Thus, the valve member 40 can be easily moved away from the tubular portion 51 of the stopper 50. In this way, the valve member 40 can be closed at the desirable timing.

When the valve member 40 is moved toward and is seated against the valve seat 34, the secondary passage 122 is closed. Thereby, the flow of the fuel through the fuel passage 100 is blocked. In this way, the metering stroke of the fuel from the pressurizing chamber 113 to the fuel chamber 16 is terminated. When the plunger 13 is moved upward, the secondary passage 122, i.e., the space defined between the pressurizing chamber 113 and the fuel chamber 16 is closed. Thereby, the quantity of the fuel, which is returned from the pressurizing chamber 113 to the fuel chamber 16, is adjusted. Therefore, the quantity of the fuel, which is pressurized in the pressurizing chamber 113, is determined.

Now, a pressurizing stroke of the plunger 13 will be described.

When the plunger 13 is further driven upward toward the top dead center in the state where the connection between the pressurizing chamber 113 and the fuel chamber 16 is closed, the pressure of the fuel in the pressurizing chamber 113 is increased. When the pressure of the fuel in the pressurizing chamber 113 becomes equal to or larger than the predetermined pressure, the check valve 92 is lifted away from the valve seat 95 against the urging force of the spring 94 at the delivery valve arrangement 90 and the force applied to the check valve 92 from the fuel on the downstream side of the valve seat 95. In this way, the delivery valve arrangement 90 is opened. Thereby, the fuel, which is pressurized in the pressurizing chamber 113, is discharged from the high pressure pump 10 through the delivery passage 114. The fuel, which is discharged from the high pressure pump 10, is supplied to and accumulated in the delivery pipe (not shown), from which the high pressure fuel is supplied to the injectors.

When the plunger 13 reaches the top dead center, the energization of the coil 71 is stopped. Thereby, the valve member 40 is lifted away from the valve seat 34 once again. At this time, the plunger 13 is driven downward in FIG. 3 once again, so that the pressure of the fuel in the pressurizing chamber 113 is reduced. In this way, the fuel is drawn from the fuel chamber 16 into the pressurizing chamber 113.

Here, it should be noted that the energization of the coil 71 may be stopped when the pressure of the fuel in the pressurizing chamber 113 is increased to the predetermined value upon the closing the valve member 40. When the pressure of the fuel in the pressurizing chamber 113 becomes large, the force, which is applied from the fuel in the pressurizing chamber 113 to the valve member 40 toward the valve seat 34, becomes larger than the force, which is applied to the valve member 40 in the direction away from the valve seat 34. Therefore, even when the energization of the coil 71 is stopped, the valve member 40 is held in the seated state where the valve member 40 is seated against the valve seat 34 by the force of the fuel applied from the pressurizing chamber 113. As discussed above, when the energization of the coil 71 is stopped at the predetermined timing, it is possible to reduce the electric power consumption of the electromagnetic drive device 70.

When the suction stroke, the metering stroke and the pressurizing stroke are repeated, the fuel, which is drawn into the high pressure pump 10, is pressurized and is discharged from the high pressure pump 10. The quantity of the fuel, which is discharged from the high pressure pump 10, is adjusted by controlling the timing of the energization of the coil 71 of the electromagnetic drive device 70.

As discussed above, in the present embodiment, in the state where the valve member 40 is engaged with the tubular portion 51 of the stopper 50 at the time of valve opening of the valve member 40, the stopper 50 covers the end part of the valve member 40, which is located on the side of the valve member 40 where the pressurizing chamber 113 is located. Therefore, the fuel, which flows from the intermediate passage 124 toward the secondary passage 122, is blocked by the stopper 50 and thereby does not collide against the end part of the valve member 40, which is located on the side of the valve member 40 where the pressurizing chamber 113 is located. In this way, even when the quantity of the fuel, which flows from the intermediate passage 124 into the secondary passage 122, becomes large, it is possible to limit the occurrence of the self-opening of the valve member 40. Therefore, the quantity of the fuel, which is discharged from the pressurizing chamber 113, is stabilized. In the present embodiment, the communication passage 55 is formed in the tubular portion 51 of the stopper 50 to communicate between the intermediate passage 124 and the volume chamber 54. Therefore, the fuel in the intermediate passage 124 flows into the volume chamber 54 through the communication passage 55. In this way, the pressure of the volume chamber 54 becomes equal to the pressure of the intermediate passage 124. Therefore, regardless of the pressure of the intermediate passage 124, the valve member 40 can be easily moved away from the tubular portion 51 of the stopper 50. Thus, the valve member 40 can be seated against the valve seat 34 at the desired timing, and thereby the response of the valve member 40 can be improved. As a result, the quantity of the fuel, which is supplied to the pressurizing chamber 113, is stabilized. Thereby, the quantity and the pressure of the fuel, which is discharged from the high pressure pump 10, can be controlled with the high accuracy.

Furthermore, according to the present embodiment, the communication passage 55 is formed at the location, which is spaced from the contact surface between the tubular portion 51 of the stopper 50 and the valve member 40 by the first predetermined distance d1 and is also spaced from the contact surface between the bottom portion 52 of the stopper 50 and the spring 21 by the second predetermined distance d2. Since the communication passage 55 is formed at the location, which is spaced from the valve member 40 by the first predetermined distance d1, it is possible to limit the collision of the flow of the fuel against the valve member 40 when the fuel flows into the volume chamber 54 through the communication passage 55. In this way, it is possible to limit the exertion of the lateral force to the valve member 40, and thereby it is possible to limit the slide malfunction and the abnormal wearing of the shaft 41 of the valve member 40. Therefore, the life time of the valve member 40 can be lengthened, and the durability of the high pressure pump 10 can be improved.

Also, according to the present embodiment, the opposed end parts of the spring 21 form the end turn portions, respectively. As discussed above, in the present embodiment, the communication passage 55 is formed at the location, which is spaced from the contact surface between the tubular portion 51 of the stopper 50 and the valve member 40 by the first predetermined distance d1. That is, in the engaged state where the stopper 50 and the valve member 40 are engaged with each other, the communication passage 55 is spaced from the contact surface between the spring 21 and the valve member 40 by the first predetermined distance d1 or more. Therefore, when the fuel flows into the volume chamber 54 through the communication passage 55, it is possible to limit the collision of the flow of the fuel against the end turn portions of the spring 21. In this way, it is possible to limit the exertion of the lateral force to the valve member 40. Furthermore, the flow of the fuel can pass through each gap between the corresponding adjacent coils of the spring 21, i.e., can pass through the portion of the spring 21, which is other than the end turn portions of the spring 21 without being blocked by the end turn portions of the spring 21. Therefore, the fuel can be smoothly supplied into the volume chamber 54.

Also, in the present embodiment, as discussed above, the communication passage 55 is formed at the location, which is spaced from the contact surface between the bottom portion 52 of the stopper 50 and the spring 21 by the second predetermined distance d2. In this way, the flow of the fuel can pass through each gap between the corresponding adjacent coils of the spring 21, i.e., can pass through the portion of the spring 21, which is other than the end turn portions of the spring 21 without being blocked by the end turn portions of the spring 21. Therefore, the fuel can be smoothly supplied into the volume chamber 54.

Furthermore, in the present embodiment, the valve member 40 has the projection 43, which is configured into the tubular form and projects from the outer peripheral edge of the valve head 42 toward the tubular portion 51 of the stopper 50. The radial width of the wall surface of the projection 43, which is engageable with the tubular portion 51, is made smaller than the radial width of the wall surface of the tubular portion 51, which is engageable with the projection 43. In other words, the outer diameter of the wall surface of the projection 43, which is engageable with the tubular portion 51, is made smaller than the outer diameter of the wall surface of the tubular portion 51, which is engageable with the projection 43. In this way, the contact surface area between the projection 43 and the tubular portion 51 can be reduced. As a result, the ringing force, which acts on the contact surface between the projection 43 and the tubular portion 51, can be reduced. In this way, the valve member 40 can be closed at the desirable timing. As a result, the quantity of the fuel, which is supplied to the pressurizing chamber 113, is stabilized.

Furthermore, according to the present embodiment, the communication passage 55 and the tertiary passages 123 are formed such that the central axis A1 of the communication passage 55 extends in the direction that is different from that of the central axis A2 of each of the tertiary passages 123. Specifically, the flow direction of the fuel, which flows through the communication passage 55, differs from the flow direction of the fuel, which flows through any one of the tertiary passages 123. Thereby, at the time of metering the fuel supplied to the pressurizing chamber 113, it is possible to reduce the direct flow of the fuel, which is supplied from the tertiary passages 123 into the intermediate passage 124, into the communication passage 55. Therefore, it is possible to alleviate the strong collision of the fuel, which is supplied from the intermediate passage 124 into the volume chamber 54 through the communication passage 55, against the valve member 40. Thereby, it is possible to limit the self-closing of the valve member 40. As a result, the quantity of the fuel, which is discharged from the pressurizing chamber 113, is stabilized.

Furthermore, according to the present embodiment, the communication passage 55 is formed at the location where the central axis A1 of the communication passage 55 intersects with the central axis A2 of the corresponding adjacent one of the tertiary passages 123. That is, at the time of metering the fuel supplied to the pressurizing chamber 113, the communication passage 55 is communicated with the intermediate passage 124 at the location adjacent to the corresponding tertiary passage 123 on the downstream side of the tertiary passage 123 in the intermediate passage 124. When the fuel flows through the tertiary passage 123 at the time of metering the fuel, the flow velocity of this fuel is increased at the time of entering from the pressurizing chamber 113 into the tertiary passage 123. Therefore, the flow velocity of the fuel in the intermediate passage 124 at the location adjacent to the tertiary passage 123 on the downstream side of the tertiary passage 123 is increased, and the corresponding pressure at this location is reduced. In the present embodiment, the communication passage 55 is connected to the intermediate passage 124 at the location on the downstream side of the tertiary passage 123. Therefore, the pressure of the volume chamber 54 can be made as low as the pressure at the location, which is adjacent to the tertiary passage 123 on the downstream side of the tertiary passage 123. Thereby, it is possible to reduce or minimize the movement of the valve member 40 toward the valve seat 34 in the valve closing direction caused by the pressure of the volume chamber 54. Thus, it is possible to limit the self-closing of the valve member 40. As a result, the quantity of the fuel, which is discharged from the pressurizing chamber 113, is stabilized.

Furthermore, in the present embodiment, the valve member 40 has the shaft 41, which is connected to the valve head 42 on the other side of the valve head 42, which is opposite from the projection 43. The valve body 30 includes the first guide portion 35 that has the first receiving through hole 351, through which the shaft 41 of the valve member 40 is slidably guided. Therefore, when the valve member 40 is moved in the valve opening direction or the valve closing direction through the needle 60 of the electromagnetic drive device 70, the valve member 40 is axially reciprocally guided with the first guide portion 35. Thus, the valve member 40 is not moved in the radial direction, and thereby the valve member 40 can be stably seated against or lifted away from the valve seat 34. Therefore, the quantity of the fuel, which is discharged from the pressurizing chamber 113, is stabilized, and thereby the quantity and the pressure of the fuel, which is discharged from the high pressure pump, can be more precisely controlled.

Furthermore, in the present embodiment, the electromagnetic drive device 70 includes the second guide portion 76 that has the second receiving through hole 761, through which the needle 60 is slidably guided. Therefore, when the valve member 40 is moved in the valve opening direction or the valve closing direction through the needle 60 of the electromagnetic drive device 70, the needle 60 is axially reciprocally guided with the second guide portion 76. Thereby, the needle 60 is not radially moved, and thereby the needle 60 can be stably engaged against the valve member 40. Thereby, the reciprocal movement of the valve member 40, which is engaged with the needle 60, is stabilized, and thereby the valve member 40 can be more stably seated against or lifted away from the valve seat 34. Therefore, the quantity of the fuel, which is discharged from the pressurizing chamber 113, is further stabilized, and thereby the quantity and the pressure of the fuel, which is discharged from the high pressure pump, can be more precisely controlled.

Second Embodiment

Figure 5:
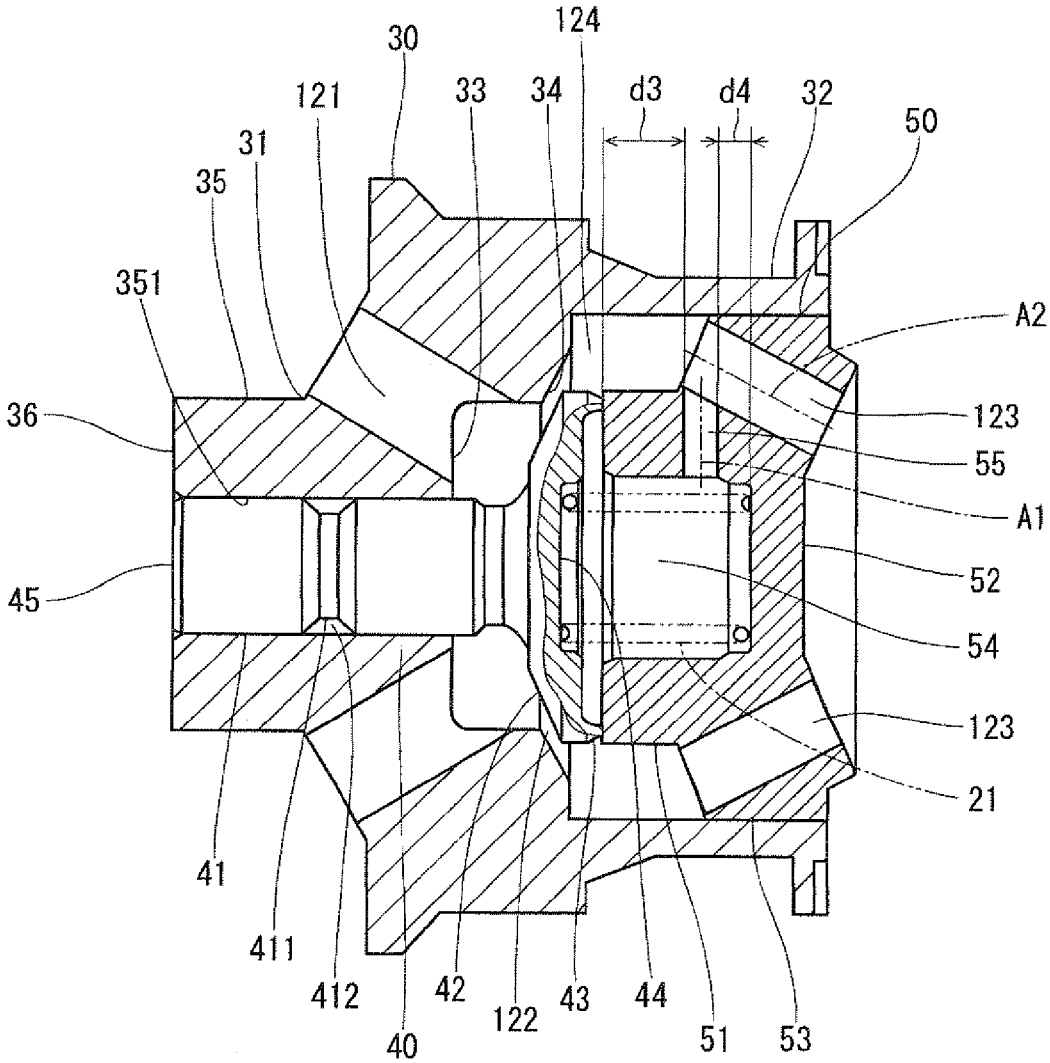
FIG. 5 is an enlarged partial cross-sectional view showing a valve body, a valve member and a stopper of a high pressure pump according to a second embodiment of the present invention.

FIG. 5 shows a portion of a high pressure pump according to a second embodiment of the present invention. In the second embodiment, a location of the communication passage, which is formed in the stopper, differs from that of the first embodiment.

In the second embodiment, the communication passage 55 is formed at the location, which is spaced from the contact surface between the tubular portion 51 of the stopper 50 and the valve member 40 by a first predetermined distance d3 and is also spaced from the contact surface between the bottom portion 52 of the stopper 50 and the spring 21 by a second predetermined distance d4. Here, the first predetermined distance d3 is set to be larger than the distance from the contact surface between the tubular portion 51 and the valve member 40 to the enlarged portion 53. Here, desirably, among the first predetermined distance d3 and the second predetermined distance d4, at least the second predetermined distance d4 is set to be larger than the axial length of the end turn portion of the spring 21.

In the present embodiment, the communication passage 55 is communicated with one of the tertiary passages 123. Specifically, the communication passage 55 communicates between the tertiary passage 123 and the volume chamber 54.

In the present embodiment, the other structure of the high pressure pump, which is other than the above-described point (the structure), is the same as that of the first embodiment.

As discussed above, according to the present embodiment, the stopper 50 has the communication passage 55, which communicates between the tertiary passage 123 and the volume chamber 54. Therefore, the fuel in the tertiary passage 123 flows into the volume chamber 54 through the communication passage 55. In this way, the pressure of the volume chamber 54 becomes equal to the pressure of the tertiary passage 123. Therefore, regardless of the pressure of the tertiary passage 123, the valve member 40 can be easily moved away from the tubular portion 51 of the stopper 50. Thus, the valve member 40 can be seated against the valve seat 34 at the desired timing, and thereby the response of the valve member 40 can be improved. As a result, the quantity of the fuel, which is discharged from the pressurizing chamber 113, is stabilized. Therefore, similar to the first embodiment, the quantity and the pressure of the fuel, which is discharged from the high pressure pump, can be more precisely controlled.

Furthermore, according to the present embodiment, the communication passage 55 is formed at the location, which is spaced from the contact surface between the tubular portion 51 of the stopper 50 and the valve member 40 by the first predetermined distance d3 and is also spaced from the contact surface between the bottom portion 52 of the stopper 50 and the spring 21 by the second predetermined distance d4. Since the communication passage 55 is formed at the location, which is spaced from the valve member 40 by the first predetermined distance d3, it is possible to limit the collision of the flow of the fuel against the valve member 40 when the fuel flows into the volume chamber 54 through the communication passage 55. In this way, it is possible to limit the exertion of the lateral force to the valve member 40, and thereby it is possible to limit the slide malfunction and the abnormal wearing of the shaft 41 of the valve member 40. Therefore, similar to the first embodiment, the life time of the valve member 40 can be lengthened, and the durability of the high pressure pump can be improved.

Furthermore, in the engaged state where the stopper 50 and the valve member 40 are engaged with each other, the communication passage 55 is spaced from the contact surface between the spring 21 and the valve member 40 by the first predetermined distance d3 or more. Therefore, when the fuel flows into the volume chamber 54 through the communication passage 55, it is possible to limit the collision of the flow of the fuel against the end turn portions of the spring 21. In this way, it is possible to limit the exertion of the lateral force to the valve member 40. Furthermore, the flow of the fuel can pass through each gap between the corresponding adjacent coils of the spring 21, i.e., can pass through the portion of the spring 21, which is other than the end turn portions of the spring 21 without being blocked by the end turn portions of the spring 21. Therefore, the fuel can be smoothly supplied into the volume chamber 54.

Also, in the present embodiment, as discussed above, the communication passage 55 is formed at the location, which is spaced from the contact surface between the bottom portion 52 of the stopper 50 and the spring 21 by the second predetermined distance d4. In this way, the flow of the fuel can pass through each gap between the corresponding adjacent coils of the spring 21, i.e., can pass through the portion of the spring 21, which is other than the end turn portions of the spring 21 without being blocked by the end turn portions of the spring 21. Therefore, the fuel can be smoothly supplied into the volume chamber 54.

Third Embodiment

Figure 6:
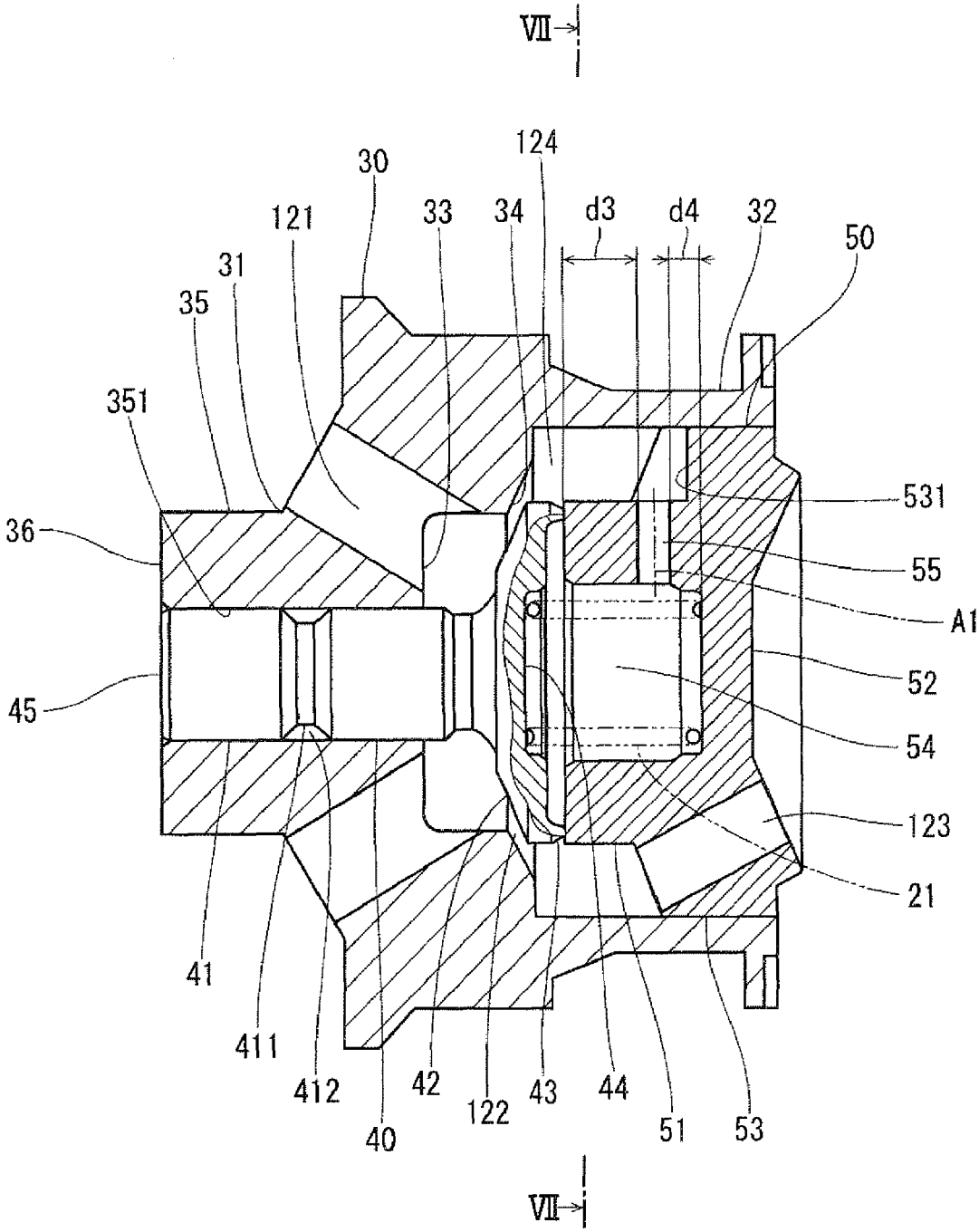
FIG. 6 is an enlarged partial cross-sectional view showing a valve body, a valve member and a stopper of a high pressure pump according to a third embodiment of the present invention.

FIG. 6 shows a portion of a high pressure pump according to a third embodiment of the present invention. In the third embodiment, a location of the communication passage, which is formed in the stopper, differs from that of the second embodiment.

In the third embodiment, similar to the second embodiment, the communication passage 55 is formed at the location, which is spaced from the contact surface between the tubular portion 51 of the stopper 50 and the valve member 40 by the first predetermined distance d3 and is also spaced from the contact surface between the bottom portion 52 of the stopper 50 and the spring 21 by the second predetermined distance d4.

Figure 7:
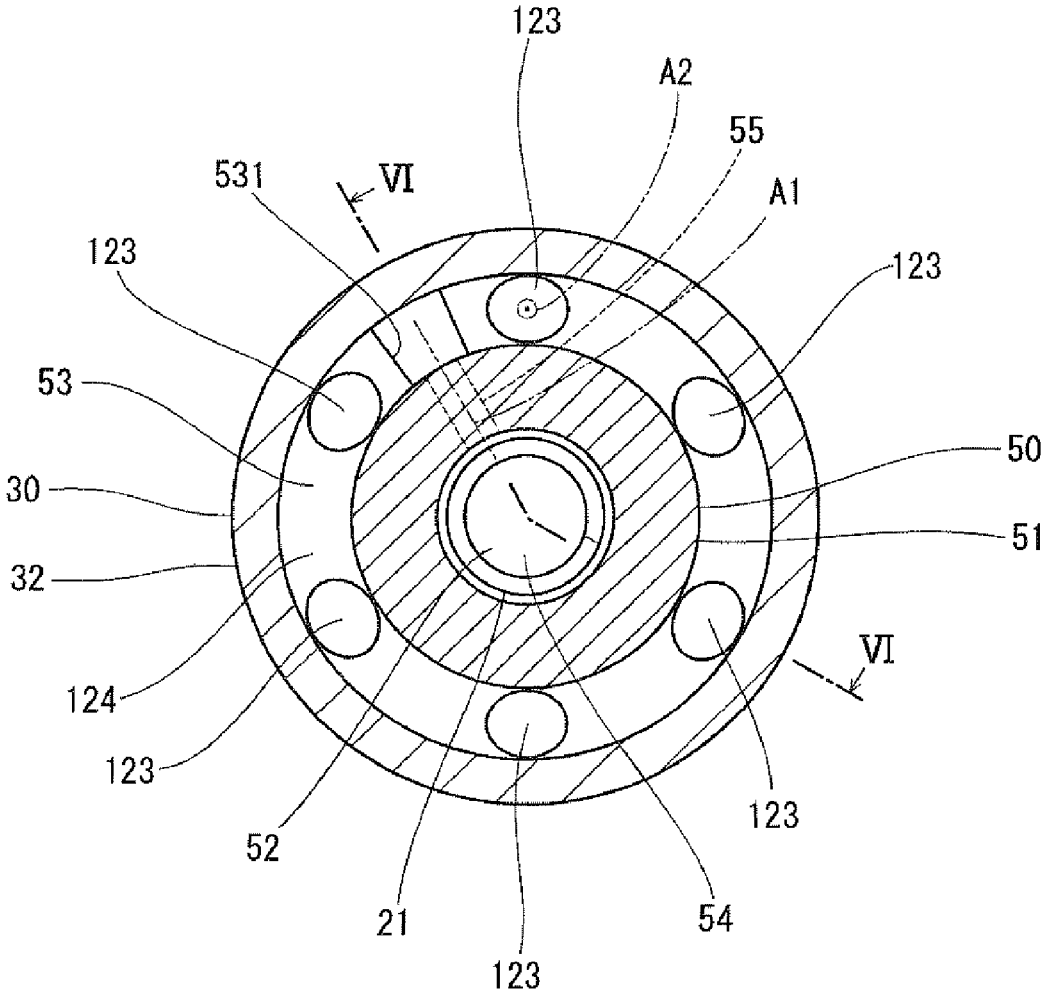
FIG. 7 is a cross sectional view taken along line VII-VII in FIG. 6.

Furthermore, in the third embodiment, unlike the second embodiment, the communication passage 55 is formed at a location, which is displaced from the adjacent tertiary passage 123 in the circumferential direction of the tubular portion 51. Thereby, the central axis A1 of the communication passage 55 does not intersect with the central axis A2 of the tertiary passage 123 (see FIG. 7).

A groove (recess) 531 is formed in the enlarged portion 53 at a location, which corresponds to the communication passage 55. In this way, the communication passage 55 is communicated with the intermediate passage 124. Therefore, the communication passage 55 can communicate between the intermediate passage 124 and the volume chamber 54.

In the present embodiment, the other structure of the high pressure pump, which is other than the above-described point (the structure), is the same as that of the second embodiment.

As discussed above, according to the present embodiment, the stopper 50 has the communication passage 55, which communicates between the intermediate passage 124 and the volume chamber 54. Thus, the valve member 40 can be seated against the valve seat 34 at the desired timing, and thereby the response of the valve member 40 can be improved. As a result, the quantity of the fuel, which is discharged from the pressurizing chamber 113, is stabilized. Therefore, similar to the second embodiment, the quantity and the pressure of the fuel, which is discharged from the high pressure pump, can be more precisely controlled.

Furthermore, similar to the second embodiment, the communication passage 55 is formed at the location, which is spaced from the contact surface between the tubular portion 51 of the stopper 50 and the valve member 40 by the first predetermined distance d3 and is also spaced from the contact surface between the bottom portion 52 of the stopper 50 and the spring 21 by the second predetermined distance d4. Therefore, the advantage, which is discussed with respect to this construction of the communication passage 55 in the second embodiment, can be equally achieved in the present embodiment.

Fourth Embodiment

Figure 8:
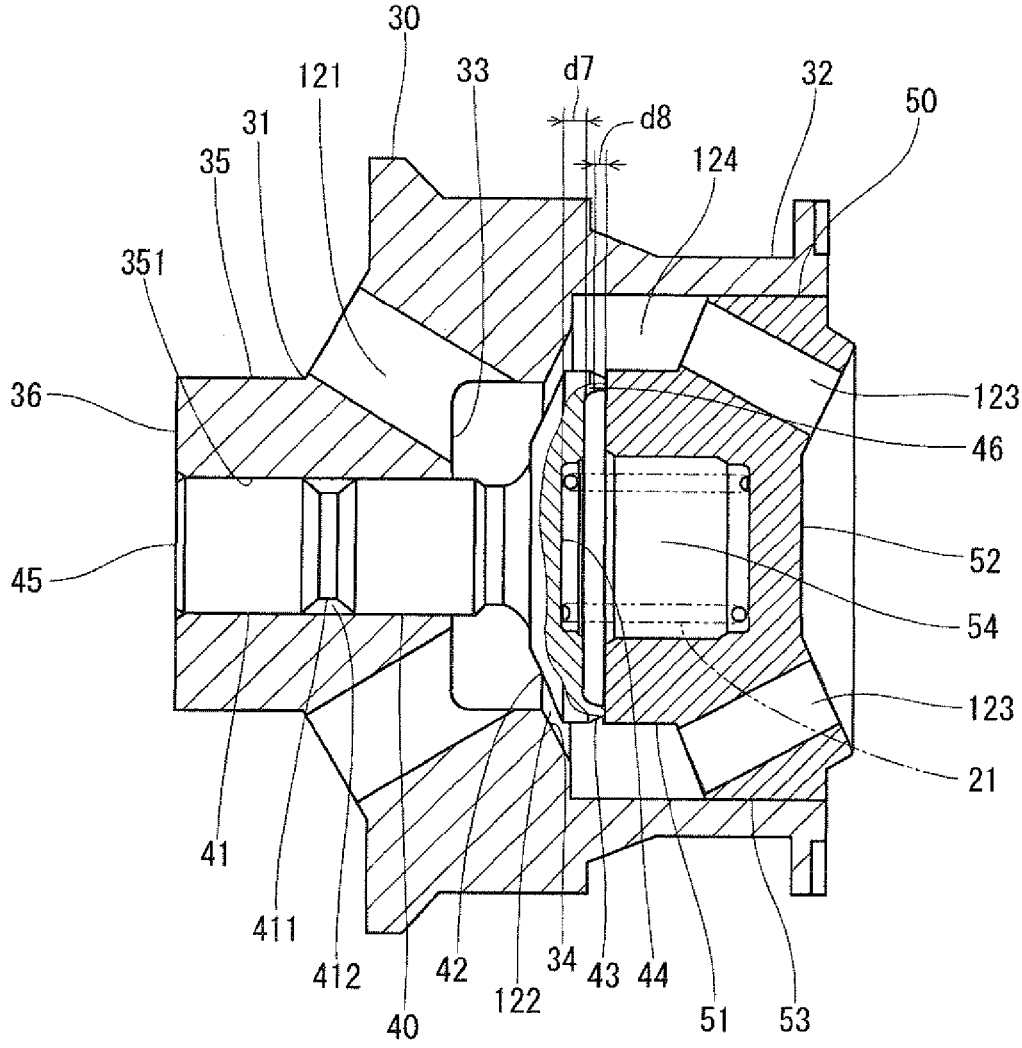
FIG. 8 is an enlarged partial cross-sectional view showing a valve body, a valve member and a stopper of a high pressure pump according to a fourth embodiment of the present invention.

FIG. 8 shows a portion of a high pressure pump according to a fourth embodiment of the present invention. In the fourth embodiment, the member (component), in which the communication passage is formed, differs from that of the first embodiment.

In the fourth embodiment, a communication passage 46 is formed in the valve member 40. More specifically, the communication passage 46 is formed in the valve member 40 at a location, which is spaced from the contact surface between the recess 44 of the valve head 42 of the valve member 40 and the spring 21 by a first predetermined distance d7 and is also spaced from the contact surface between the valve member 40 and the tubular portion 51 of the stopper 50 by a second predetermined distance d8. Here, desirably, the first predetermined distance d7 is set to be larger than the axial length of the end turn portion of the spring 21. In the present embodiment, the communication passage 46 is formed in the projection 43 of the valve member 40. With the above construction, the communication passage 46 can communicate between the intermediate passage 124 and the volume chamber 54.

In the present embodiment, the other structure of the high pressure pump, which is other than the above-described point (the structure), is the same as that of the first embodiment.

As discussed above, according to the present embodiment, the valve member 40 has the communication passage 46, which communicates between the intermediate passage 124 and the volume chamber 54. Therefore, the fuel in the intermediate passage 124 flows into the volume chamber 54 through the communication passage 46. In this way, the pressure of the volume chamber 54 becomes equal to the pressure of the intermediate passage 124. Therefore, regardless of the pressure of the intermediate passage 124, the valve member 40 can be easily moved away from the tubular portion 51 of the stopper 50. Thus, the valve member 40 can be seated against the valve seat 34 at the desired timing, and thereby the response of the valve member 40 can be improved. As a result, the quantity of the fuel, which is supplied to the pressurizing chamber 113, is stabilized. Therefore, the quantity and the pressure of the fuel, which is discharged from the high pressure pump, can be more precisely controlled.

Furthermore, in the present embodiment, the communication passage 46 is formed in the valve member 40 at the location, which is spaced from the contact surface between the recess 44 of the valve head 42 of the valve member 40 and the spring 21 by the first predetermined distance d7 and is also spaced from the contact surface between the valve member 40 and the tubular portion 51 of the stopper 50 by the second predetermined distance d8. Since the communication passage 46 is formed at the location, which is spaced from the contact surface between the recess 44 of the valve member 40 and the spring 21 by the first predetermined distance d7, it is possible to limit the collision of the fuel against the end turn portion of the spring 21 upon intrusion of the fuel into the volume chamber 54 through the communication passage 46. In this way, it is possible to limit the exertion of the lateral force to the valve member 40. Furthermore, in the present embodiment, the flow of the fuel can pass through each gap between the corresponding adjacent coils of the spring 21 (other than the end turn portions) without being blocked by the end turn portions, so that the fuel can be smoothly flow into the volume chamber 54.

In the present embodiment, the inner diameter of the communication passage 46 is set to a corresponding size, which enables that the flow of the fuel, which flows into the volume chamber 54 through the communication passage 46, does not collide against the opposed portion (the projection 43 in the present embodiment), which is opposed to the communication passage 46 of the valve member 40. In this way, it is possible to limit the exertion of the lateral force to the valve member 40.

Fifth Embodiment

Figure 9:
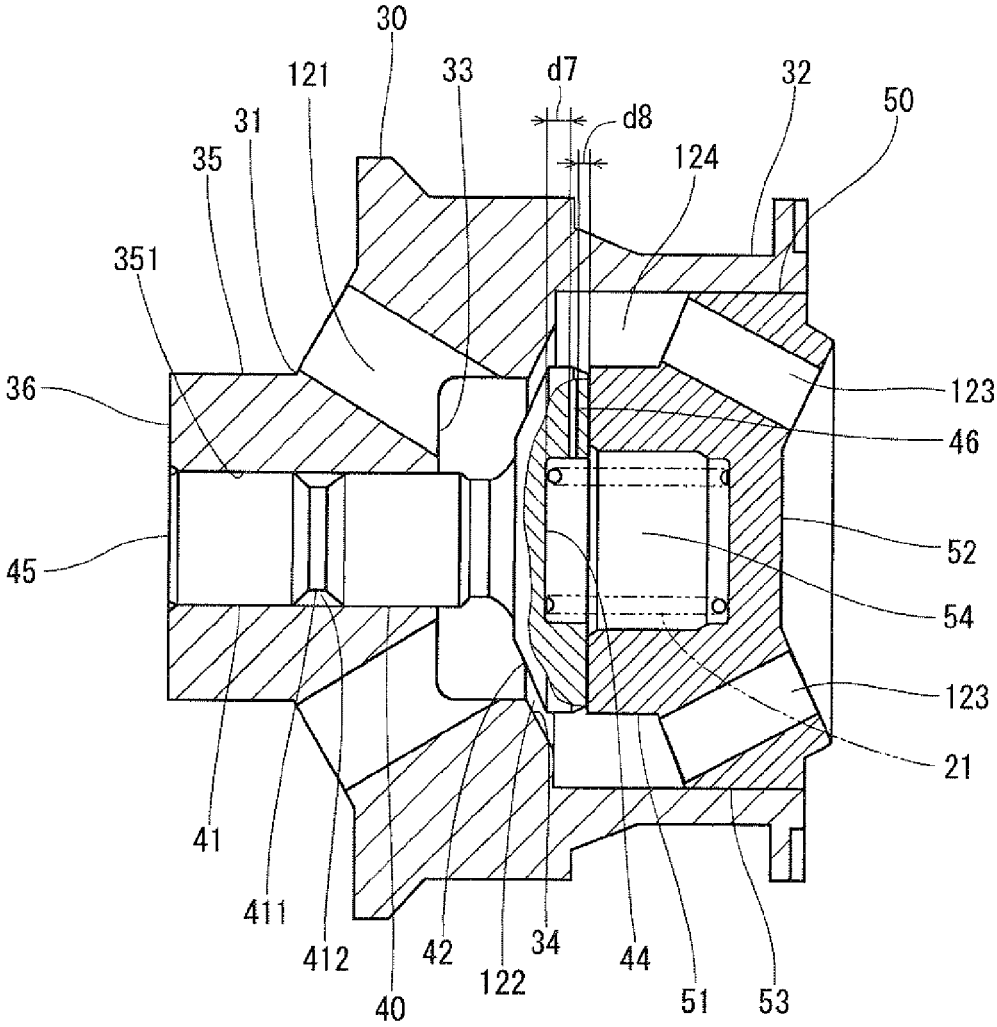
FIG. 9 is an enlarged partial cross-sectional view showing a valve body, a valve member and a stopper of a high pressure pump according to a fifth embodiment of the present invention.

FIG. 9 shows a portion of a high pressure pump according to a fifth embodiment of the present invention. In the fifth embodiment, the member (component or the location), in which the communication passage is formed, differs from that of the fourth embodiment.

In the fifth embodiment, the projection 43 of the above embodiments is not formed in the valve head 42 of the valve member 40. Therefore, according to the present embodiment, the contact surface area between the valve member 40 and the stopper 50 is larger than that of the fourth embodiment.

Furthermore, in the fifth embodiment, the communication passage 46 is formed in the valve member 40 at the location, which is spaced from the contact surface between the recess 44 of the valve head 42 of the valve member 40 and the spring 21 by the first predetermined distance d7 and is also spaced from the contact surface between the valve member 40 and the tubular portion 51 of the stopper 50 by the second predetermined distance d8. In the present embodiment, the communication passage 46 is communicated with the space (the portion of the volume chamber 54), which is defined by the recess 44 of the valve member 40. With the above construction, the communication passage 46 can communicate between the intermediate passage 124 and the volume chamber 54.

In the present embodiment, the other structure of the high pressure pump, which is other than the above-described point (the structure), is the same as that of the fourth embodiment.

As discussed above, according to the present embodiment, the valve member 40 has the communication passage 46, which communicates between the intermediate passage 124 and the volume chamber 54. Thus, the valve member 40 can be seated against the valve seat 34 at the desired timing, and thereby the response of the valve member 40 can be improved. As a result, the quantity of the fuel, which is discharged from the pressurizing chamber 113, is stabilized. Therefore, similar to the fourth embodiment, the quantity of the fuel, which is discharged from the high pressure pump, can be more precisely controlled.

Furthermore, as discussed above, the communication passage 46 is formed at the location, which is spaced from the contact surface between the recess 44 of the valve head 42 of the valve member 40 and the spring 21 by the first predetermined distance d7 and is also spaced from the contact surface between the valve member 40 and the tubular portion 51 of the stopper 50 by the second predetermined distance d8. Therefore, the advantage, which is discussed with respect to the location of the communication passage 46 of the fourth embodiment, can be equally achieved in the present embodiment.

In the present embodiment, the inner diameter of the communication passage 46 is set to a corresponding size, which enables that the flow of the fuel, which flows into the volume chamber 54 through the communication passage 46, does not collide against the opposed portion (the wall surface of the recess 44 of the valve head 42 in the present embodiment), which is opposed to the communication passage 46 of the valve member 40. In this way, it is possible to limit the exertion of the lateral force to the valve member 40.

Now, modifications of the above embodiments will be described.

For instance, the central axis of the communication passage, which is formed in the stopper or the valve member, may extend in the same direction as that of the central axis of the corresponding adjacent tertiary passage as long as there is not negative influential factor. Furthermore, similar to the third embodiment, the communication passage of the other embodiments other than the third embodiment may be at the location, at which the central axis of the communication passage does not intersect with the central axis of the corresponding adjacent tertiary passage. Furthermore, in the above embodiments, the single communication passage is formed in the stopper or the valve member. Alternatively, a plurality of communication passages, which are arranged one after another in the circumferential direction, may be formed in the stopper or the valve member.

In the fourth and fifth embodiments, the communication passage is formed in the valve member. Here, the inner diameter of the communication passage, which is formed in the valve member in the fourth or fifth embodiment, may be increased to increase the flow quantity of the fuel, which passes through the communication passage. In this case, when another communication passage is provided at the location, which is diametrically opposed to the above-described communication passage, the fuel, which is discharged into the volume chamber from one of the communication passages, collides with the fuel, which is discharged into the volume chamber from the other one of the communication passages, so that it is possible to limit the generation of the lateral force exerted to the valve member.

In the fifth embodiment, the valve head of the valve member is directly engaged with the tubular portion of the stopper. Alternatively, in the other embodiments of the present invention, a tubular projection, which is similar to the tubular projection discussed in the first embodiment, may be formed in the valve head of the valve member, so that the tubular projection and the tubular portion of the stopper are engageable with each other. In this way, the ringing force, which is exerted at the contact surface between the valve member and the stopper, can be reduced.

In the above embodiments, when the coil arrangement of the electromagnetic drive device is not energized, the valve member is lifted away from the valve seat.

Then, when the coil arrangement of the electromagnetic drive device is energized, the valve member is seated against the valve seat. That is, the normally-closed type valve structure is discussed. Alternatively, a normally-open type valve structure, in which the valve member is lifted away from the valve seat upon the energization of the coil arrangement, may be used.

Additional advantages and modifications will readily occur to those skilled in the art. The invention in its broader terms is therefore not limited to the specific details, representative apparatus, and illustrative examples shown and described.

What is claimed is:

1. A high pressure pump comprising:

a plunger that is reciprocally movable;

a housing that includes:

a pressurizing chamber, in which fuel is pressurized by the plunger; and a fuel passage, which guides the fuel to the pressurizing chamber;

a valve body that is placed in the fuel passage and includes a valve seat in a wall surface of the valve body on one side of the valve body, at which the pressurizing chamber is located;

a valve member that is placed in the valve body and is slidable along the valve body, wherein the valve member includes a valve head, which is seatable against the valve seat to disable flow of the fuel through the fuel passage and is also liftable away from the valve seat to enable the flow of the fuel through the fuel passage;

a stopper that is placed on one side of the valve member, at which the pressurizing chamber is located, wherein the stopper includes:

a tubular portion;

a bottom portion that closes to fluid one end part of the tubular portion, which is opposite from the valve member; and an annular expanded portion, which extends radially outward from the bottom portion, wherein when the valve member is engaged with the other end part of the tubular portion, which is opposite from the bottom portion, the stopper covers one end part of the valve member on the one side of the valve member, at which the pressurizing chamber is located, and limits movement of the valve member in a valve opening direction thereof, so that a volume chamber is formed by the valve member, an inner peripheral wall of the tubular portion and the bottom portion;

a first urging member that is placed radially inward of the tubular portion and is engaged with the valve member and the bottom portion to urge the valve member in a valve closing direction thereof;

a needle that has one end part, which is engageable with the other end part of the valve member that is opposite from the stopper, wherein the needle is movable together with the valve member in a common direction at the valve opening time or the valve closing time of the valve member;

a second urging member that urges the needle in the valve opening direction of the valve member; and an electromagnetic drive device that includes a coil arrangement, which attracts the needle in one of the valve closing direction and the valve opening direction of the valve member, wherein:

the fuel passage includes:

a primary passage that is formed on one side of the valve seat of the valve body, which is opposite from the pressurizing chamber;

a secondary passage that is configured into an annular form, wherein the secondary passage is formed between the valve member and the valve seat when the valve member is lifted away from the valve seat;

a tertiary passage that is formed in the expanded portion of the stopper; and an intermediate passage, which is formed between the secondary passage and the tertiary passage;

the stopper includes a communication passage that communicates between the volume chamber and one of the intermediate passage and the tertiary passage; and the communication passage is formed at a location, which is spaced from a contact surface between the tubular portion and the valve member by a first predetermined distance and is also spaced from a contact surface between the bottom portion and the first urging member by a second predetermined distance.

2. The high pressure pump according to claim 1, wherein:

the valve member includes a projection, which is configured into a tubular form and projects from an outer peripheral edge of the valve head toward the stopper;

when an end part of the projection on a stopper side of the projection is engaged with the other end part of the tubular portion, which is on a valve member side of the tubular portion, the volume chamber is formed; and a radial width of a wall surface of the projection, which is engageable with the tubular portion, is smaller than a radial width of a wall surface of the tubular portion, which is engageable with the projection.

3. The high pressure pump according to claim 1, wherein the communication passage and the tertiary passage are formed such that a central axis of the communication passage extends in a direction that is different from that of a central axis of the tertiary passage.

4. The high pressure pump according to claim 3, wherein the communication passage is placed such that the central axis of the communication passage intersects with the central axis of the tertiary passage.

5. The high pressure pump according to claim 2, wherein:

the valve member further includes a shaft, which is connected to the valve head on the other side of the valve head opposite from the projection; and the valve body includes a first guide portion that has a first receiving through hole, in which the shaft is slidably received.

6. The high pressure pump according to claim 1, wherein the electromagnetic drive device further includes a second guide portion that has a second receiving through hole, in which the needle is slidably received.

7. A high pressure pump comprising:

a plunger that is reciprocally movable;

a housing that includes:

a pressurizing chamber, in which fuel is pressurized by the plunger; and a fuel passage, which guides the fuel to the pressurizing chamber;

a valve body that is placed in the fuel passage and includes a valve seat in a wall surface of the valve body on one side of the valve body, at which the pressurizing chamber is located;

a valve member that is placed in the valve body and is slidable along the valve body, wherein the valve member includes a valve head, which is seatable against the valve seat to disable flow of the fuel through the fuel passage and is also liftable away from the valve seat to enable the flow of the fuel through the fuel passage;

a stopper that is placed on one side of the valve member, at which the pressurizing chamber is located, wherein the stopper includes:

a tubular portion;

a bottom portion that closes to fluid one end part of the tubular portion, which is opposite from the valve member; and an annular expanded portion, which extends radially outward from the bottom portion, wherein when the valve member is engaged with the other end part of the tubular portion, which is opposite from the bottom portion, the stopper covers one end part of the valve member on the one side of the valve member, at which the pressurizing chamber is located, and limits movement of the valve member in a valve opening direction thereof, so that a volume chamber is formed by the valve member, an inner peripheral wall of the tubular portion and the bottom portion;

a first urging member that is placed radially inward of the tubular portion and is engaged with the valve member and the bottom portion to urge the valve member in a valve closing direction thereof;

a needle that has one end part, which is engageable with the other end part of the valve member that is opposite from the stopper, wherein the needle is movable together with the valve member in a common direction at the valve opening time or the valve closing time of the valve member;

a second urging member that urges the needle in the valve opening direction of the valve member; and an electromagnetic drive device that includes a coil arrangement, which attracts the needle in one of the valve closing direction and the valve opening direction of the valve member, wherein:

the fuel passage includes:

a primary passage that is formed on one side of the valve seat of the valve body, which is opposite from the pressurizing chamber;

a secondary passage that is configured into an annular form, wherein the secondary passage is formed between the valve member and the valve seat when the valve member is lifted away from the valve seat;

a tertiary passage that is formed in the expanded portion of the stopper; and an intermediate passage, which is formed between the secondary passage and the tertiary passage;

the valve head includes a recess that is formed in a surface of the valve head on one side of the valve head, at which the stopper is located, and is recessed in a direction that is opposite from the stopper;

the other end part of the first urging member, which is opposite from the bottom portion, is engaged with the recess;

the valve member includes a communication passage, which communicates between the intermediate passage and the volume chamber; and the communication passage is formed at a location, which is spaced from a contact surface between the recess and the first urging member by a first predetermined distance and is also spaced from a contact surface between the valve member and the tubular portion by a second predetermined distance.

8. The high pressure pump according to claim 7, wherein:

the valve member includes a projection, which is configured into a tubular form and projects from an outer peripheral edge of the valve head toward the stopper;

when an end part of the projection on a stopper side of the projection is engaged with the other end part of the tubular portion, which is on a valve member side of the tubular portion, the volume chamber is formed; and a radial width of a wall surface of the projection, which is engageable with the tubular portion, is smaller than a radial width of a wall surface of the tubular portion, which is engageable with the projection.

9. The high pressure pump according to claim 7, wherein the communication passage and the tertiary passage are formed such that a central axis of the communication passage extends in a direction that is different from that of a central axis of the tertiary passage.

10. The high pressure pump according to claim 9, wherein the communication passage is placed such that the central axis of the communication passage intersects with the central axis of the tertiary passage.

11. The high pressure pump according to claim 8, wherein:

the valve member further includes a shaft, which is connected to the valve head on the other side of the valve head opposite from the projection; and the valve body includes a first guide portion that has a first receiving through hole, in which the shaft is slidably received.

12. The high pressure pump according to claim 7, wherein the electromagnetic drive device further includes a second guide portion that has a second receiving through hole, in which the needle is slidably received.

13. The high pressure pump according to claim 1, wherein:

the valve head of the valve member is engageable with the other end part of the tubular portion to form the volume chamber with the valve head of the valve member, the inner peripheral wall of the tubular portion and the bottom portion; and a wall of the valve head is continuously formed throughout the valve head to limit flow of fuel into and out of the volume chamber through the wall of the valve head when the valve head is engaged with the other end part of the tubular portion.

14. The high pressure pump according to claim 1, wherein the stopper is located only on one axial side of the valve head of the valve member, at which the pressurizing chamber is located, without extending into the other axial side of the valve head of the valve member.

15. The high pressure pump according to claim 1, wherein the valve head is circumferentially continuously engageable with the other end part of the tubular portion along an entire circumference of the valve head.

16. The high pressure pump according to claim 7, wherein:

the valve head of the valve member is engageable with the other end part of the tubular portion to form the volume chamber with the valve head of the valve member, the inner peripheral wall of the tubular portion and the bottom portion; and a wall of the valve head is continuously formed throughout the valve head to limit flow of fuel into and out of the volume chamber through the wall of the valve head when the valve head is engaged with the other end part of the tubular portion.

17. The high pressure pump according to claim 7, wherein the stopper is located only on one axial side of the valve head of the valve member, at which the pressurizing chamber is located, without extending into the other axial side of the valve head of the valve member.

18. The high pressure pump according to claim 7, wherein the valve head is circumferentially continuously engageable with the other end part of the tubular portion along an entire circumference of the valve head.

* * * * *